US009045278B2

(12) United States Patent
Mustafa et al.

(10) Patent No.: US 9,045,278 B2
(45) **Date of Patent: *Jun. 2, 2015**

(54) INSULATED SHIPPING CONTAINER AND METHOD OF MAKING THE SAME

(75) Inventors: Neritan Mustafa, Milford, MA (US); Mark Banks, Millis, MA (US); James Nilsen, Mays Landing, NJ (US); Lawrence A. Gordon, Southborough, MA (US)

(73) Assignee: Cold Chain Technologies, Inc., Holliston, LA (US)

( * ) Notice: Subject to any disclaimer, the term of this patent is extended or adjusted under 35 U.S.C. 154(b) by 271 days.

This patent is subject to a terminal disclaimer.

(21) Appl. No.: 13/595,499

(22) Filed: Aug. 27, 2012

(65) Prior Publication Data

US 2013/0055750 A1 Mar. 7, 2013

Related U.S. Application Data

(63) Continuation of application No. 12/231,425, filed on Sep. 2, 2008, now Pat. No. 8,250,882, which is a continuation-in-part of application No. PCT/US2007/005524, filed on Mar. 2, 2007.

(60) Provisional application No. 60/847,321, filed on Sep. 25, 2006, provisional application No. 60/778,309, filed on Mar. 2, 2006.

(51) Int. Cl.

| | |
|---|---|
| ***F25D 3/06*** | (2006.01) |
| ***B65D 81/38*** | (2006.01) |
| ***F25D 3/08*** | (2006.01) |

(52) U.S. Cl.

CPC ..... *B65D 81/3862* (2013.01); *F25D 3/08* (2013.01); *F25D 2303/0843* (2013.01); *F25D 2331/804* (2013.01); *F25D 2500/02* (2013.01)

(58) Field of Classification Search

CPC ..... B65D 81/3862; F25D 3/08
USPC ..... 62/371–372, 60; 220/23.83, 592.23, 220/592.26, 292.23, 592.1, 592.03, 592.25; 229/103.11

See application file for complete search history.

(56) References Cited

U.S. PATENT DOCUMENTS

| | | | |
|---|---|---|---|
| 5,450,977 | A | 9/1995 | Moe |
| 5,501,338 | A | 3/1996 | Preston |
| 5,709,307 | A | 1/1998 | Rosado et al. |
| 5,897,017 | A | 4/1999 | Lantz |
| 5,924,302 | A | 7/1999 | Derifield |

(Continued)

FOREIGN PATENT DOCUMENTS

WO WO 2007/103267 A2 9/2007

*Primary Examiner* — Cassey D Bauer
(74) *Attorney, Agent, or Firm* — Kriegsman & Kriegsman

(57) ABSTRACT

Insulated shipping container and method of making the same. In a preferred embodiment, the insulated shipping container includes an outer box, an insulated insert, an insulated cover, a payload container and a plurality of coolant members. The insulated insert is snugly, but removably, disposed within the outer box and is shaped to include a plurality of sides and a top. The top includes a raised peripheral edge and a recessed shelf. A large rectangular prismatic cavity surrounded by a plurality of smaller cavities extends downwardly from the recessed shelf. The large cavity of the insulated insert is adapted to receive a payload container. Each of the smaller cavities of the insulated insert has a "top hat" shape when viewed from above that includes a crown portion and a brim portion.

24 Claims, 26 Drawing Sheets

(56) References Cited

U.S. PATENT DOCUMENTS

| | | | | |
|---|---|---|---|---|
| 6,044,650 | A | 4/2000 | Cook et al. | |
| 6,257,764 | B1 | 7/2001 | Lantz | |
| 6,868,982 | B2 | 3/2005 | Gordon | |
| 8,250,882 | B2 * | 8/2012 | Mustafa et al. | 62/457.2 |
| 2003/0102317 | A1 | 6/2003 | Gordon | |
| 2005/0150244 | A1 | 7/2005 | Hillmann et al. | |
| 2005/0224501 | A1 | 10/2005 | Folkert et al. | |

* cited by examiner

FIG. 18
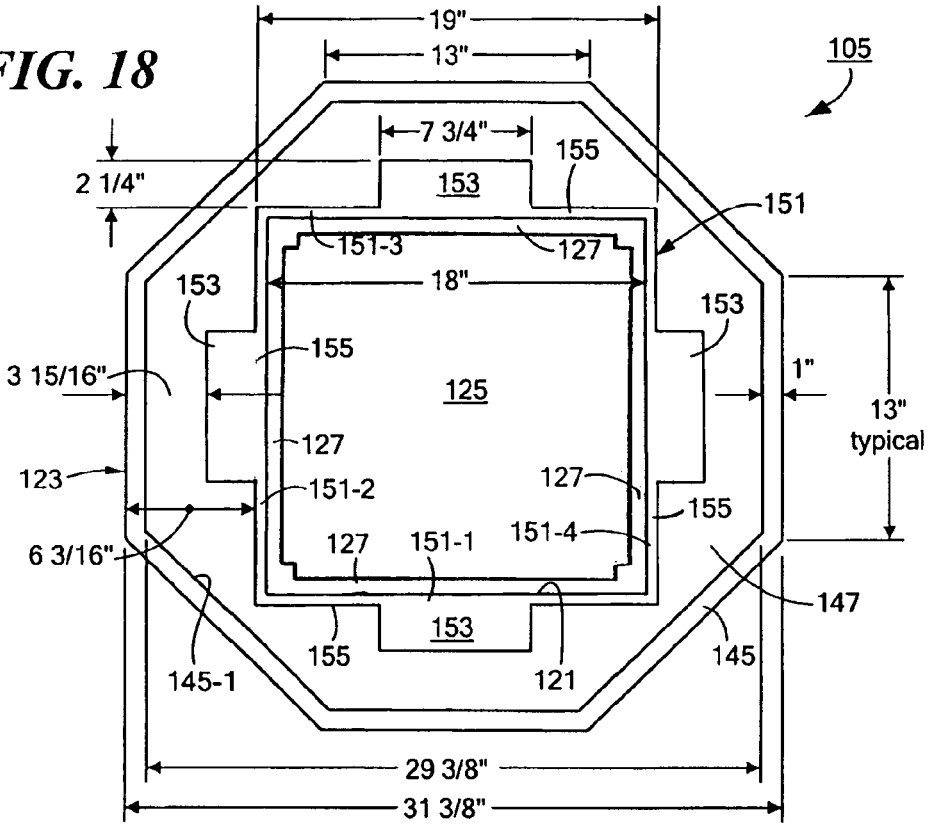
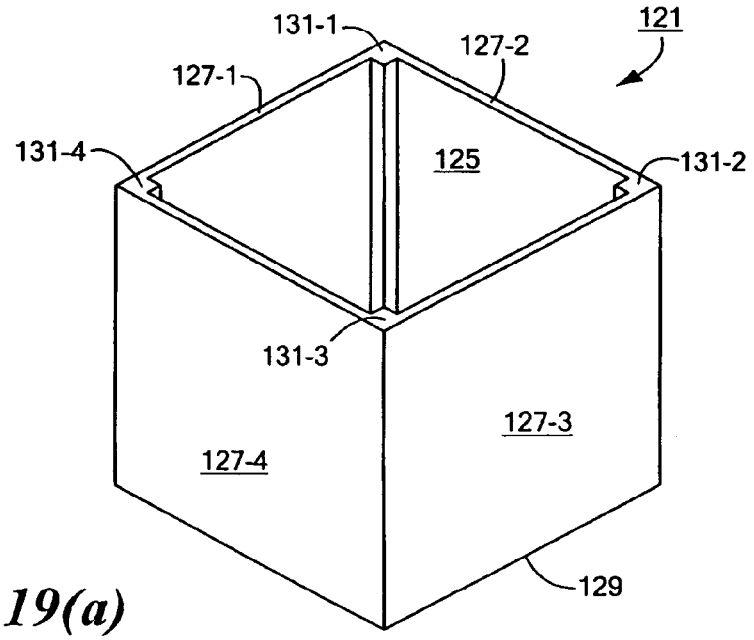
FIG. 19(a)

INSULATED SHIPPING CONTAINER AND METHOD OF MAKING THE SAME

CROSS-REFERENCE TO RELATED APPLICATIONS

The present application is a continuation of U.S. patent application Ser. No. 12/231,425, filed Sep. 2, 2008, which, in turn, is a continuation-in-part of PCT Application No. PCT/US07/05524, filed Mar. 2, 2007, which, in turn, claims the benefit under 35 U.S.C. 119(e) of U.S. Provisional Patent Appln. No. 60/847,321, filed Sep. 25, 2006, and U.S. Provisional Patent Appln. No. 60/778,309, filed Mar. 2, 2006. All of the above-identified patent applications are incorporated herein by reference.

BACKGROUND OF THE INVENTION

The present invention relates generally to insulated shipping containers and relates more particularly to insulated shipping containers of the type which are formed at least in part of foamed polymer material.

Conventional insulated shipping containers of the so-called box-within-a-box configuration are well-known. These conventional box-within-a-box containers typically have an outer box formed of corrugated cardboard and a smaller, open-topped, inner box also formed of corrugated cardboard, the outer and inner boxes defining a void space therebetween. During manufacture of such shipping containers, the void space is filled with a foamed-in-place polymer material, said foamed-in-place polymer material typically being a light-to-medium density foamed polyurethane material.

Typically, the manufacture of such box-within-a-box containers comprises mounting the inner box, in an inverted position, over a manufacturing fixture having an upstanding plug member. Next, the outer box is inverted onto the manufacturing fixture with its top closure flaps turned outward, and its bottom closure flaps opened. The manufacturing fixture includes an outer movable wall structure which supports the side walls of the outer box. The polymer material in a liquid pre-foamed condition is then sprayed or poured into the void space between the two boxes and is allowed to foam in place. The foaming of the polymer material takes a sufficient period of time that the bottom closure flaps of the box may be closed before the foam fills the entirety of the void space, and a lid is closed over these closure flaps to support the box against the internal pressure created by the foaming polymer. As this polymer material foams in place, it bonds to both the inner and outer boxes and exerts a considerable pressure against both the inner and outer boxes. In fact, were it not for the support to these boxes provided by the manufacturing fixture, the boxes would be seriously distorted or destroyed by the foam pressure. After an additional period of time (total time of ten minutes or less), the foam hardens sufficiently that the substantially finished shipping container may be removed from the fixture.

In using such conventional insulated shipping containers, it is common for one or more articles being shipped therein to be inserted into the inner box of the container, together with dry ice or other temperature stabilizing packs and packing material. A form-fitting block of comparatively thick, open-cell foam is then inserted into the opening of the inner box. This open-cell foam serves as a thermal insulator and prevents the infusion of ambient air into the inner box and the escape of temperature-controlled air from within the inner box. Next, the top closure flaps of the outer box are closed and taped, and the shipping container is ready for shipment with the attachment of a shipping label thereto.

Unfortunately, the above-described conventional insulated shipping container has certain shortcomings. One significant shortcoming is that the materials of the container are not recyclable because the foamed polymer material bonds directly to the inner and outer cardboard boxes and cannot thereafter easily be separated therefrom. This shortcoming is an ever-increasing concern as more and more states and countries require that shipping materials which have destinations within their jurisdictions be recyclable or otherwise be subject to a penalty tax or fee for special disposal. Moreover, if the outer box becomes damaged or otherwise marked, it cannot be replaced in such a way as to permit the container to be reused.

One suggestion that has been proposed to allow the separation of foamed polymer material from the cardboard boxes of the aforementioned type of container has been to simply bunch a flat sheet of plastic film within the outer box and over the inner box before the foam polymer material in a liquid form is injected. However, the bunching of a flat sheet of plastic film in the above-described manner typically results in the formation of many folds and fissures in the excess sheet material. These many folds and fissures often form many airflow pathways through which temperature-controlled air can escape from the container, and through which ambient air can enter. Also, as can readily be appreciated, the aforementioned bunching of the plastic film typically results in variations in the thickness of the insulative foamed polymer in the vicinity of said folds and fissures. As a result, some containers made by this method possess one or more areas where the insulating foam is too thin and where, in effect, the contents are exposed to "hot spots" or "cold spots" of ambient air leaking into the container. Because one potential application of insulated shipping containers is in the transport of temperature-sensitive medical specimens or materials which are irreplaceable or critical to the well-being of a patient, the risks associated with using a shipping container made using a bunched flat sheet in the above-described manner are often too great.

In U.S. Pat. No. 5,897,017, inventor Lantz, which issued Apr. 27, 1999, and in U.S. Pat. No. 6,257,764, inventor Lantz, which issued Jul. 10, 2001, both of which are incorporated herein by reference, there is disclosed a recyclable insulated shipping container that addresses many of the above-described shortcomings associated with the use of a bunched flat sheet to separate foamed polymer material from a cardboard box. More specifically, the two Lantz patents above disclose an insulated shipping container that includes a specially-designed plastic bag into which the foam polymer material in a liquid form is injected to yield a body of foamed polymer material substantially contained within the specially-designed plastic bag, the body of foamed polymer material defining a chamber therein and an opening outwardly from the chamber surrounded by a transition surface, the specially-designed plastic bag including a rectangular end portion and a curved transition section extending from the rectangular end portion to a transverse line at which the bag defines a hoop dimension sufficient to allow the bag to extend across the transition surface of the body of foamed polymer material.

Because of its tailored shape, the Lantz bag has a minimal number of folds and fissures and, therefore, results in a body of foamed polymer material that is substantially uniformly thick and substantially free of fissures. Unfortunately, as can readily be appreciated, because of its unusual shape, the Lantz bag can be expensive to manufacture, thereby resulting in a shipping container that is expensive to manufacture.

In U.S. Pat. No. 5,924,302, inventor Derifield, which issued Jul. 20, 1999, and which is incorporated herein by reference, there is disclosed a shipping container including an insulated body having a cavity for holding a product being shipped, and having one or more cavities for holding coolant in a predetermined relationship to the product. The container also includes an insulated cover adapted to sealably engage an open end of the insulated body after a product and coolant are received therein. The cover includes one or more blocks or prongs extending therefrom that are adapted to slidably engage the coolant cavities and/or the product cavity to substantially minimize air spaces in the cavities and/or seal them. The insulated body and cover preferably are formed from injection molded polyurethane, wrapped in a plastic film and inserted into a cardboard shipping carton.

In U.S. Pat. No. 6,868,982, inventor Gordon, which issued Mar. 22, 2005, and which is incorporated herein by reference, there is disclosed an insulated shipping container and a method of making the same. In a preferred embodiment, the insulated shipping container comprises an outer box, an insulated insert, an inner box and a closure member. The outer box, which is preferably made of corrugated fiberboard, comprises a rectangular prismatic cavity bounded by a plurality of rectangular side walls, a closed bottom end, and top closure flaps. The insulated insert is snugly, but removably, disposed within the outer box and is shaped to define a rectangular prismatic cavity bounded by a bottom wall and a plurality of rectangular side walls, the insulated insert having an open top end. The insulated insert is made of a foamed polyurethane body to which on all sides, except its bottom, a thin, flexible, unfoamed polymer bag is integrally bonded. The bag is a unitary structure having a generally uniform rectangular shape, the bag being formed by sealing shut one end of a tubular member with a transverse seam and forming longitudinal creases extending from opposite ends of the seam. The inner box, which is snugly, but removably, disposed within the insert, is preferably made of corrugated fiberboard and is shaped to include a rectangular prismatic cavity bounded by a plurality of rectangular side walls and a closed bottom end, the top end thereof being open. The closure member is a thick piece of foam material snugly, but removably, disposed in the open end of the inner box.

Additional shipping containers are described in the following patents and published patent applications, all of which are incorporated herein by reference: U.S. Pat. No. 6,044,650, inventors Cook et al., which issued Apr. 4, 2000; U.S. Pat. No. 5,709,307, inventors Rosado et al., which issued Jan. 20, 1998; U.S. Pat. No. 5,450,977, inventor Moe, which issued Sep. 19, 1995; U.S. Pat. No. 5,501,338, inventor Preston, which issued Mar. 26, 1996; U.S. Patent Appln. Publication No. US 2005/0224501 A1, inventors Folkert et al., which was published Oct. 13, 2005; and U.S. Patent Appln. Publication No. US 2003/0102317 A1, inventor Gordon, which was published Jun. 5, 2003.

The shipping containers described above, while suitable for many purposes, are not capable of meeting certain shipping requirements, such as being able to maintain an article contained therein at a temperature of between 2° C. and 8° C. for 48 hours while subjected to summer-like and winter-like ambient temperatures. The ability to maintain an article at a temperature of between 2° C. and 8° C. for 48 hours or longer under summer-like and winter-like ambient temperatures is very important for shipping certain temperature sensitive materials, such as certain biologicals and pharmaceuticals.

SUMMARY OF THE INVENTION

It is an object of the present invention to provide a novel insulated shipping container.

It is another object of the present invention to provide an insulated shipping container as described above that addresses at least some of the shortcomings associated with existing insulated shipping containers.

It is still another object of the present invention to provide a method of making an insulated shipping container of the type described above.

According to one aspect of the invention, there is provided an insulated shipping container, said insulated shipping container comprising: (a) an insulated insert, said insulated insert being a unitary body shaped to include a bottom, a plurality of sides and a top, the top including a raised peripheral edge and a recessed shelf, at least one product cavity and at least one coolant cavity extending downwardly from the recessed shelf, the at least one coolant cavity, when viewed from above, having a top-hat shape comprising a crown portion and a brim portion; and (b) an insulated lid, the insulated lid being removably mounted on the insulated insert in such a way as to cover the top of the insulated insert.

According to another aspect of the invention, there is provided an insulated shipping container, said insulated shipping container comprising: (a) an insulated insert, said insulated insert having an open top and defining a central product cavity and a plurality of coolant cavities surrounding said central product cavity, each of said coolant cavities, when viewed from above, having a top-hat shape comprising a crown portion and a brim portion; (b) an insulated lid, the insulated lid being removably mounted on the insulated insert in such a way as to cover the open top of the insulated insert; and (c) a coolant member removably received in each of said coolant cavities, the coolant member being adapted to fit within the crown portion of the coolant cavity, with the brim portion of the coolant cavity remaining empty.

For purposes of the present specification and claims, relational terms like "top," "bottom," "upper," and "lower" are used to describe the present invention in a context in which the open-end of the storage cavity of the container is facing upwardly. It is to be understood that, by orienting the container such that the storage cavity faces in a direction other than upwardly, the directionality of the invention will need to be adjusted accordingly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts:

FIG. 18 is a top view of the insulated insert shown in FIG. 14;

DETAILED DESCRIPTION OF PREFERRED EMBODIMENTS

Figure 1:
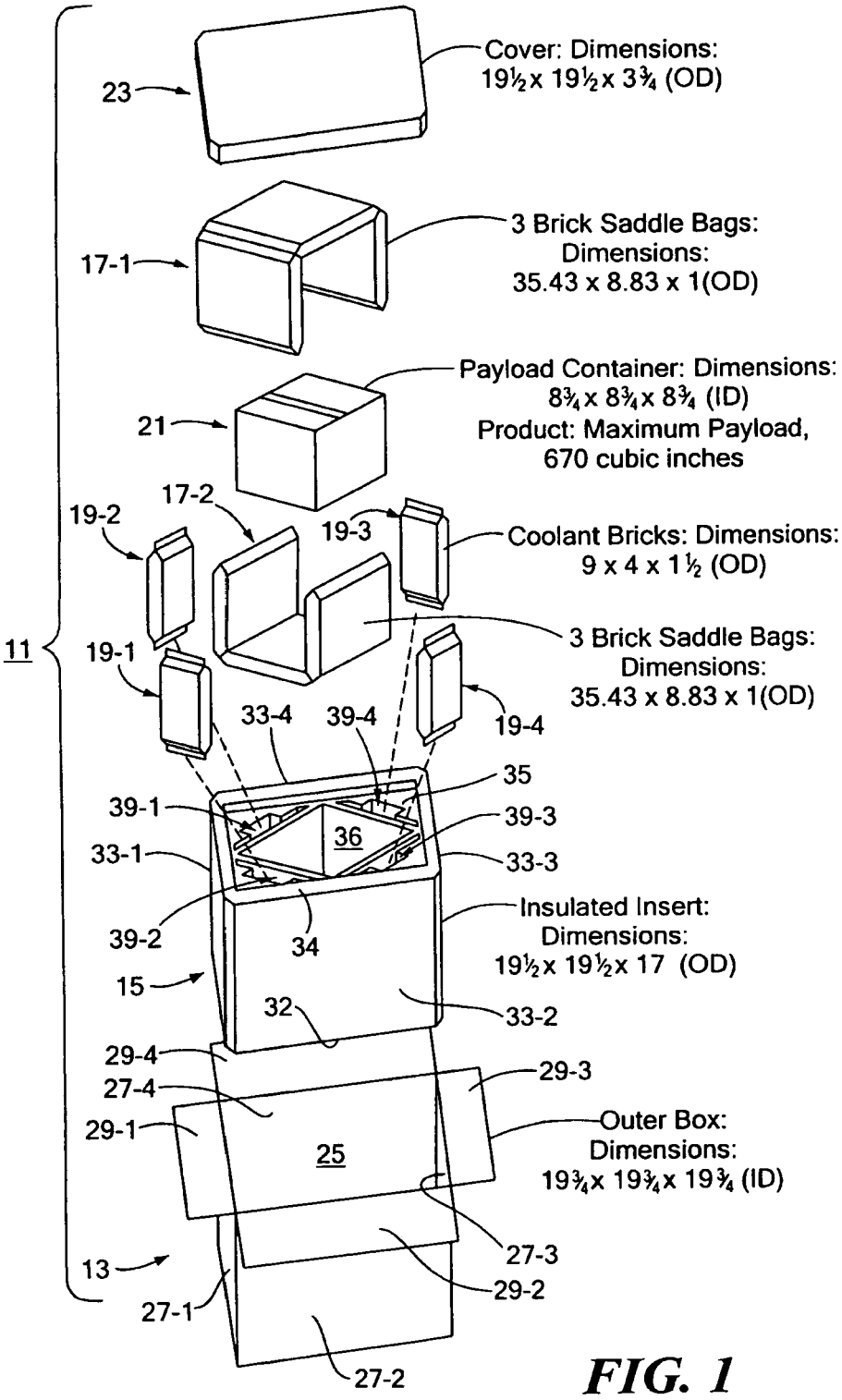
FIG. 1 is an exploded perspective view of a first embodiment of an insulated shipping container constructed according to the teachings of the present invention.

Referring now to FIG. 1, there is shown an exploded perspective view of a first embodiment of an insulated shipping container constructed according to the teachings of the present invention, said insulated shipping container being represented generally by reference numeral 11.

Container 11 comprises an outer box 13, an insulated insert 15, a pair of coolant saddlebags 17-1 and 17-2, a plurality of coolant bricks 19-1 through 19-4, a payload container 21 and an insulated cover 23.

Outer box 13, which is preferably a corrugated fiberboard or corrugated plastic box and which may be conventional in construction, comprises a rectangular prismatic cavity 25 bounded by a plurality of rectangular side walls 27-1 through 27-4, a plurality of bottom closure flaps (not shown), and a plurality of top closure flaps 29-1 through 29-4. Adhesive strips of tape or other adhesive means (not shown) may be used to retain in a closed condition the bottom closure flaps and top closure flaps 29-1 through 29-4.

Figure 2:
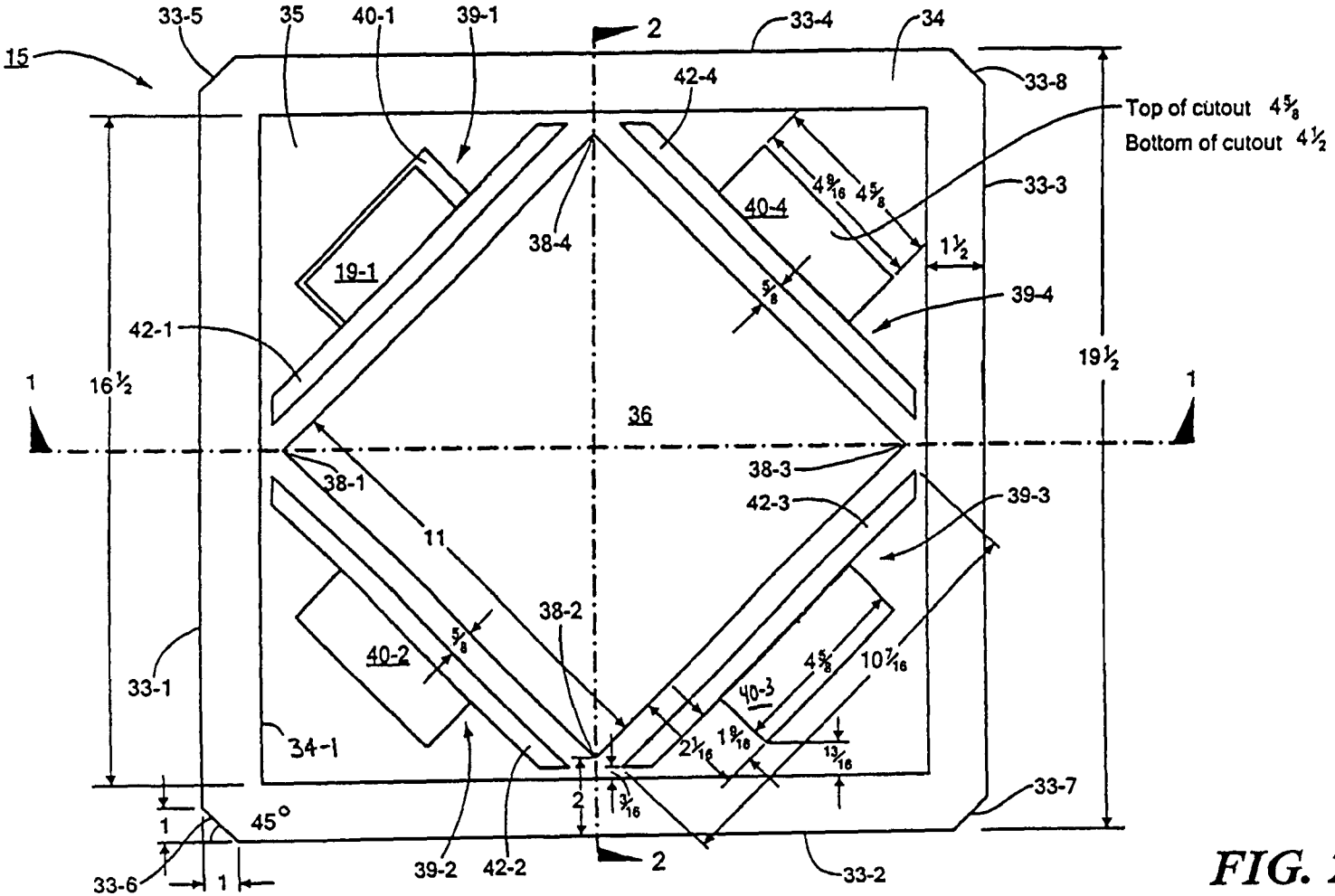
FIG. 2 is an enlarged top view of the insulated insert shown in FIG. 1, the insulated insert being shown with a brick disposed within a coolant cavity.
Figure 3:
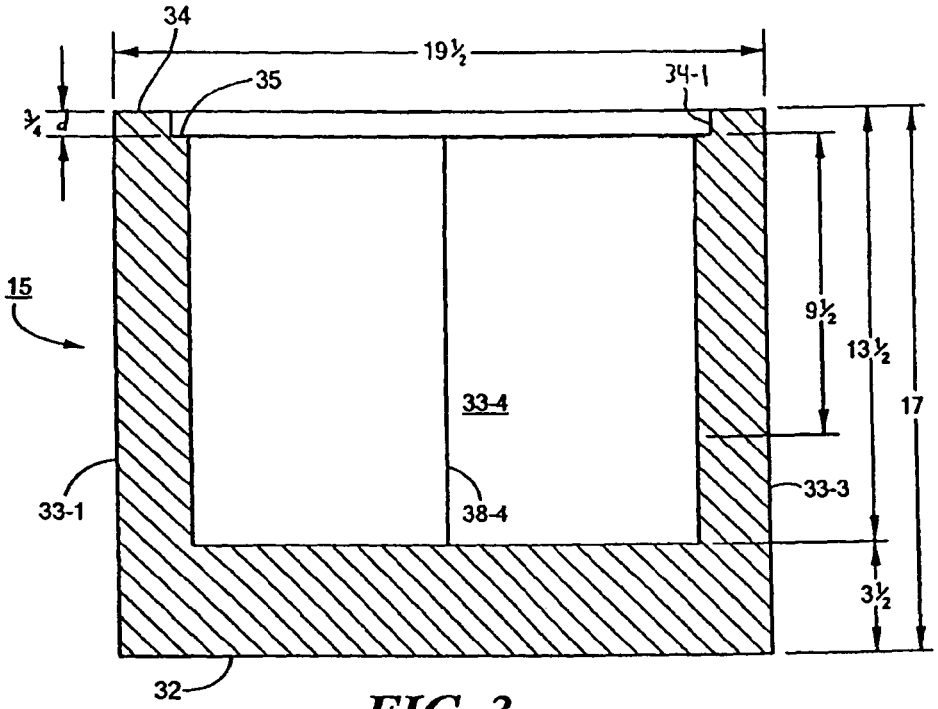
FIG. 3 is a section view of the insulated insert of FIG. 2 taken along line 1-1.
Figure 4:
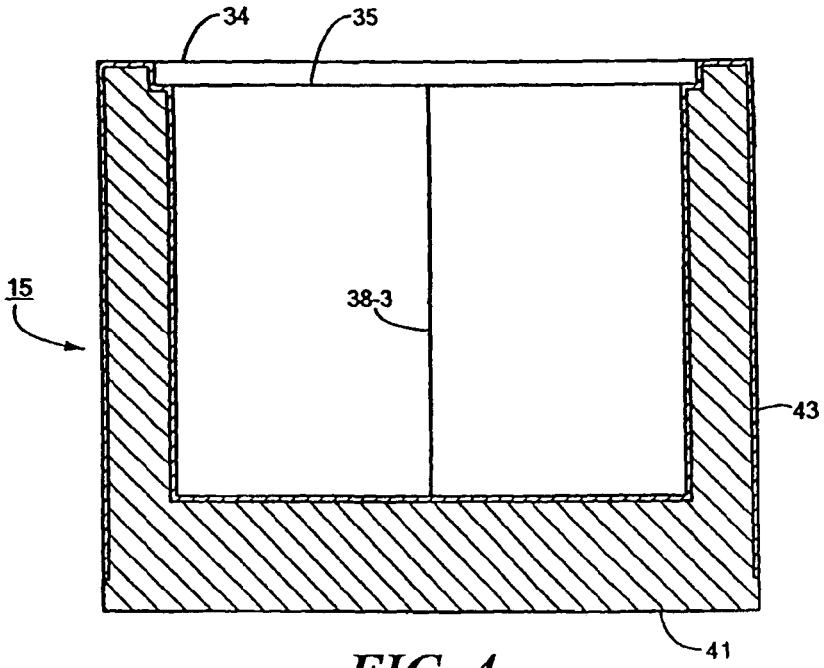
FIG. 4 is a section view of the insulated insert of FIG. 2 taken along line 2-2.

Insulated insert 15, which is also shown in FIGS. 2 through 4, is shaped to include a bottom 32, four sides 33-1 through 33-4, and a top. The top of insert 15 is shaped to include a raised peripheral lip 34 surrounding a recessed shelf 35. A generally rectangular prismatic cavity 36, which is adapted to receive payload container 21 and saddlebags 17-1 and 17-2, extends downwardly a distance from shelf 35. As can be seen, cavity 36 is oriented so that its corners 38-1 through 38-4 substantially bisect sides 33-1 through 33-4, respectively (i.e., so that cavity 36 is offset 45 degrees relative to sides 33-1 through 33-4). A plurality of coolant cavities 39-1 through 39-4 are provided in insert 15 and extend downwardly from shelf 35, cavities 39-1 through 39-4 being evenly spaced peripherally around cavity 36. When viewed from above, each of coolant cavities 39-1 through 39-4 has a "top hat" shape, with each of cavities 39 including a comparatively wider but shorter and shallower "crown" section 40 (e.g., 4.5"×9.5"×1.75") and a comparatively narrower but longer and deeper "brim" section 42 (e.g., 13.5"×10.5"×0.375"). Section 40 is adapted to loosely receive a coolant brick 19, with the unoccupied portion of section 40 and the completely unoccupied section 42 (which unoccupied portions represent approximately 50% of the total volume of cavities 39) providing air spaces for convection, such convection being important in endowing container 11 with its thermal properties.

Insert 15 is slidably removably disposed within cavity 25 of outer box 13, with sides 33-1 through 33-4 of insert 15 snugly abutting the inside surfaces of side walls 27-1 through 27-4, respectively, and bottom 32 of insert 15 seated upon the bottom closure flaps of outer box 13. To facilitate the insertion and removal of insert 15 into and from outer box 13, respectively, beveled surfaces 33-5 through 33-8 are provided at the corners of sides 33-1 through 33-4.

As seen best in FIG. 4, insert 15 comprises a body 41 of foamed polymer material, preferably a foamed polyurethane. Blowing agents may be used to form said foamed polyurethane, such blowing agents including, for example, hydrofluorocarbons (HFC), such as HFC-134a or HFC-245, as well as carbon dioxide, methyl formate, cyclopentanes, and hydrochlorofluorocarbons. Insert 15 also comprises a thin, flexible, non-self-supporting, unfoamed polymer bag 43, bag 43 preferably being made of hexene or a polyethylene (preferably a high density polyethylene). Bag 43 is integrally bonded and conformal to body 41, with bag 43 covering much of the outer surface of body 41 including all of cavity 36 (but very little or none of cavities 39-1 through 39-4). Bag 43 is a unitary structure made by sealing shut one end of a tubular member with a transverse seam and by forming longitudinal creases extending from opposite ends of said seam. As can be appreciated, bag 43 has a generally constant width and uniform inside dimension along its length.

Insert 15 may be made in a manner generally similar to that used to make insert 31 of U.S. Pat. No. 6,868,982, except that, in the present invention, after the positioning of bag 43 in the forming tool but prior to the introduction of the polymer foam into the bag, four appropriately dimensioned blocks are fastened to the bottom inside end of the forming tool through bag 43 for use in creating cavities 39-1 and 39-4 at what will become the top end of insert 15. After the foam has set in the tool, insert 15 is removed from the tool and the four aforementioned blocks are removed from insert 15 to yield cavities 39-1 through 39-4.

Figure 5A:
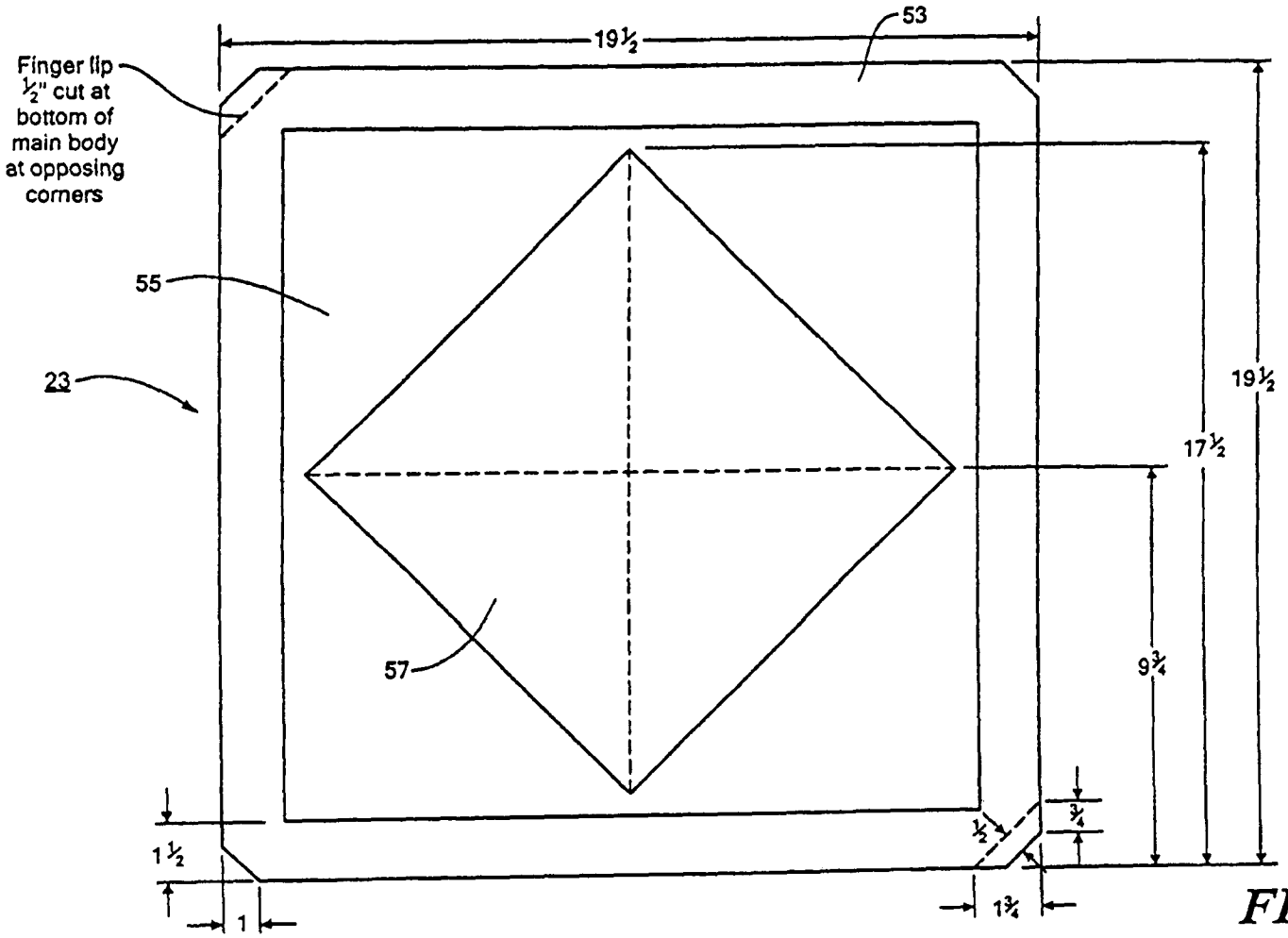
FIGS. 5(*a*) and 5(*b*) are enlarged bottom and side views, respectively, of the lid shown in FIG. 1.
Figure 5B:
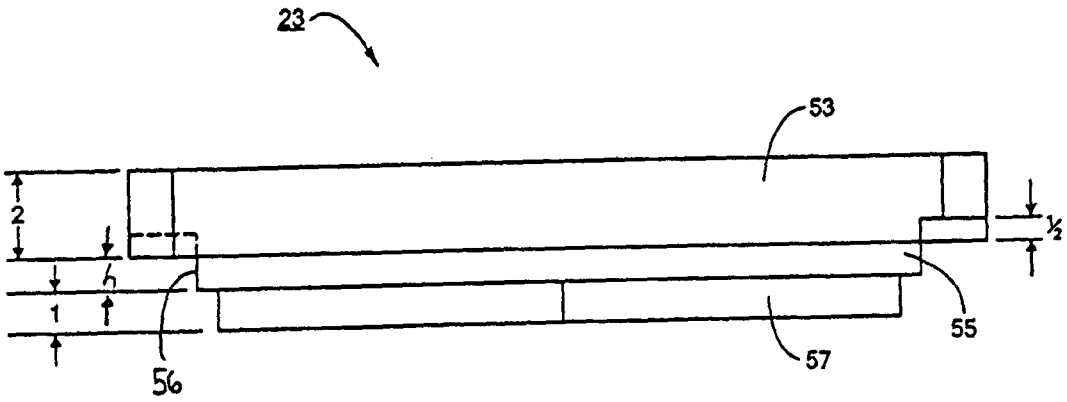

Insulated cover 23, which is also shown in FIGS. 5(*a*) and 5(*b*), is shaped to include a top portion 53, an intermediate portion 55 and a bottom portion 57. Top portion 53 is appropriately dimensioned to sit upon and to match the outer dimensions of lip 34 of insert 15. Intermediate portion 55 has an outer periphery 56 that is appropriately dimensioned to abut the inner surface 34-1 of lip 34, thereby sealing the open top end of insert 15. However, it should be noted that intermediate portion 55 has a height h that is less than the depth d of lip 34; as a result, a convection space is created between the bottom surface of intermediate portion 55 and the top surface of shelf 35, said convection space communicating with each of cavities 39-1 through 39-4. The present inventors believe that such a convection space is important in endowing container 11 with its thermal properties. Bottom portion 57, which is generally square-shaped, is appropriately dimensioned to be inserted into cavity 36 of insert 15. It should be noted that bottom portion 57 is undersized relative to cavity 36 so that bottom portion does not seal cavity 36. In this manner, cavities 39-1 through 39-4 are permitted to communicate with cavity 36.

Preferably, cover 23 has a similar composition to insert 15 and comprises a body of foamed polymer material, preferably a foamed polyurethane (which may be formed using the same types of blowing agents discussed above in connection with cover 23), encased in a thin, flexible, non-self-supporting, unfoamed polymer bag made of hexene or a polyethylene (preferably a high density polyethylene).

Figure 6A:
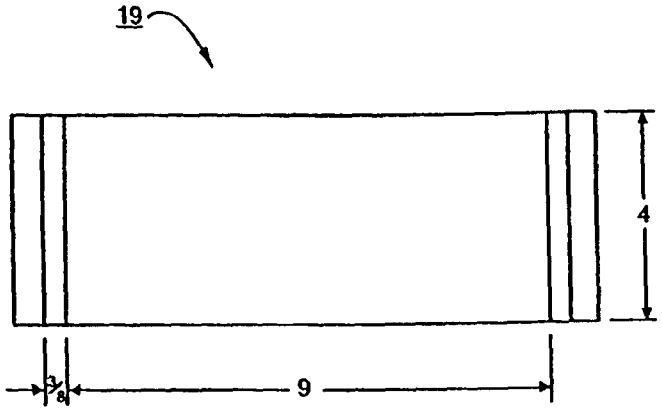
FIGS. 6(*a*) and 6(*b*) are enlarged top and side views, respectively, of one of the bricks shown in FIG. 1.
Figure 6B:
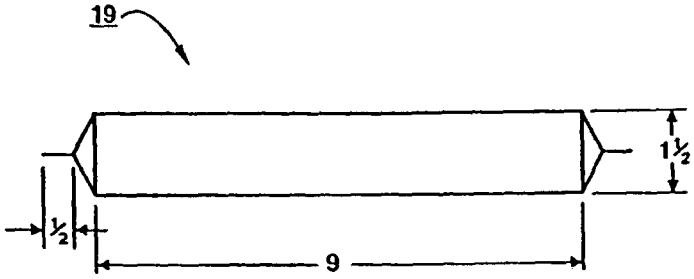

Coolant bricks 19-1 through 19-4, one of which is separately shown in FIGS. 6(*a*) and 6(*b*), comprise a foam refrigerant block of hexahedron shape (e.g., 9"×4"×1.5") encased in a flexible metal foil. As noted above, bricks 19-1 through 19-4 are dimensioned to loosely fit within sections 40-1 through 40-4, respectively, with the top of each foam refrigerant block preferably positioned a short distance below the top of its respective coolant cavity 39. In fact, once coolant bricks 19-1 through 19-4 are placed within sections 40-1 through 40-4, respectively, there is an air space within each of sections 40-1 through 40-4 of approximately 0.5"×1.75"×4" volume above the foam refrigerant block which consists of nothing more than the foil wrapper seam and excess air space.

Figure 7A:
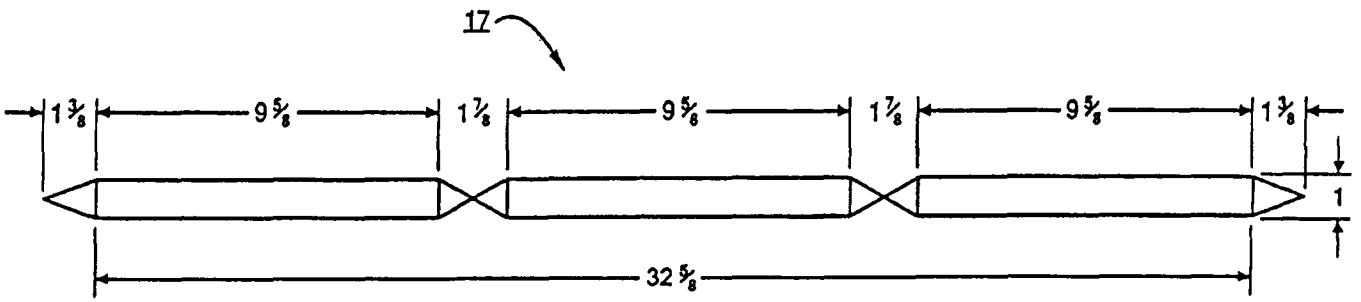
FIGS. 7(*a*) and 7(*b*) are enlarged top and side views, respectively, of one of the saddle bags shown in FIG. 1, the saddle bag being shown in an unfolded state.
Figure 7B:
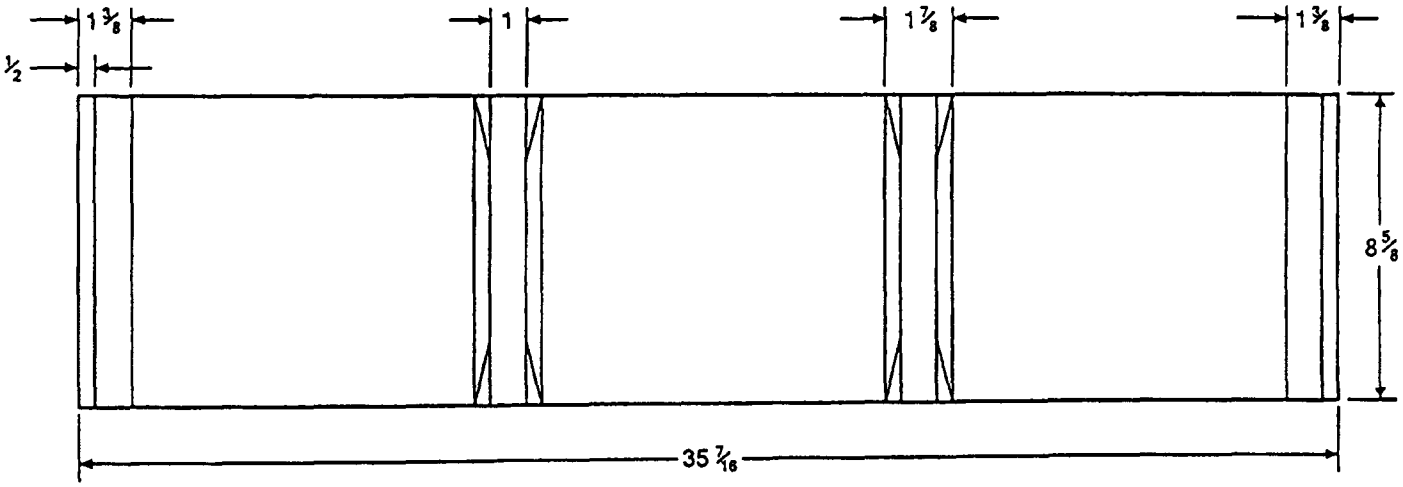

Saddle bags 17-1 and 17-2, one of which is separately shown in FIGS. 7(*a*) and 7(*b*), comprise a series of three of foam refrigerant blocks of hexahedron shape (e.g., 9.625"×8.625"×1") encased within and interconnected by an appropriately sealed, flexible, metal foil. Saddlebags 17-1 and 17-2 are appropriately dimensioned to be inserted with payload container 21 into cavity 36, with saddlebags 17-1 and 17-2 surrounding payload container 21 on all six faces.

Payload container 21, which is preferably a corrugated fiberboard or corrugated plastic box and which may be conventional in construction, is adapted to receive a temperature sensitive product. In those instances in which the temperature sensitive product does not occupy the entirety of payload container 21, packaging material (e.g., bubblewrap) may be positioned around the product inside payload container 21 to fill some or all of the remaining space.

Although container 11 may be varied in size to suit particular applications, illustrative dimensions for a preferred embodiment are shown in the drawings.

Figure 8:
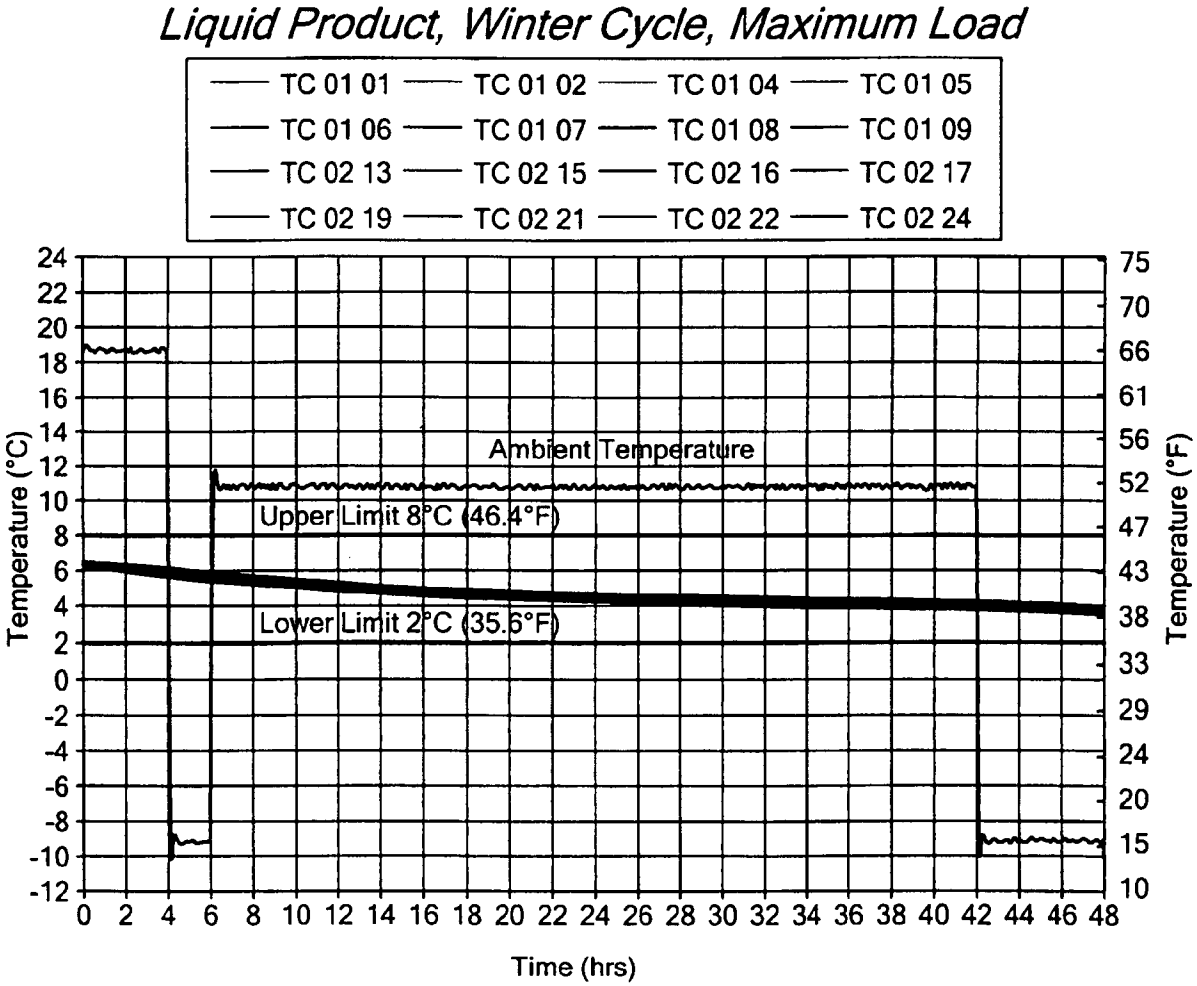
FIGS. 8 through 13 are graphs, illustrating thermal tests for the insulated container of FIG. 1 performed under simulated 48-hour summer and winter conditions.
Figure 9:
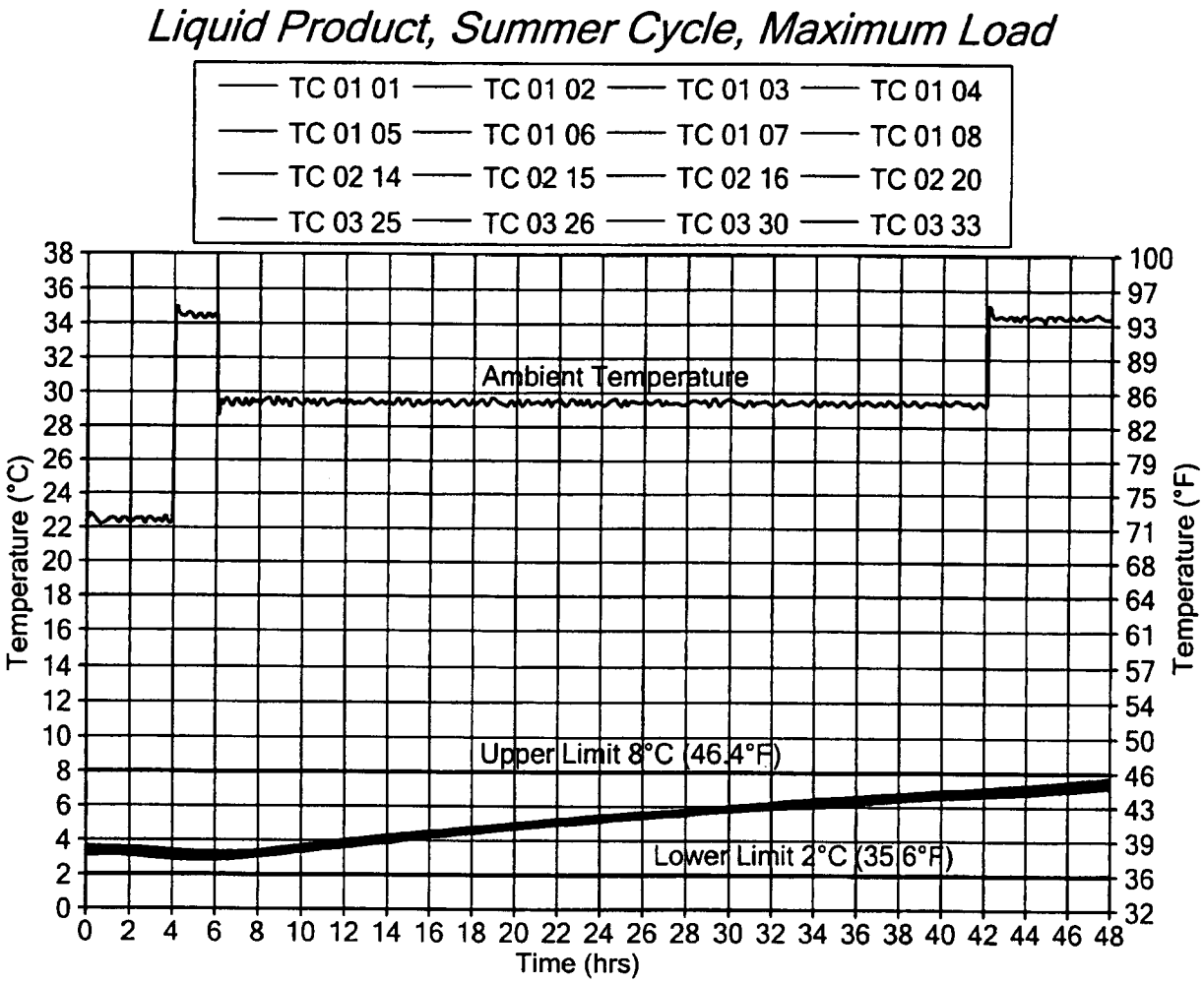
Figure 10:
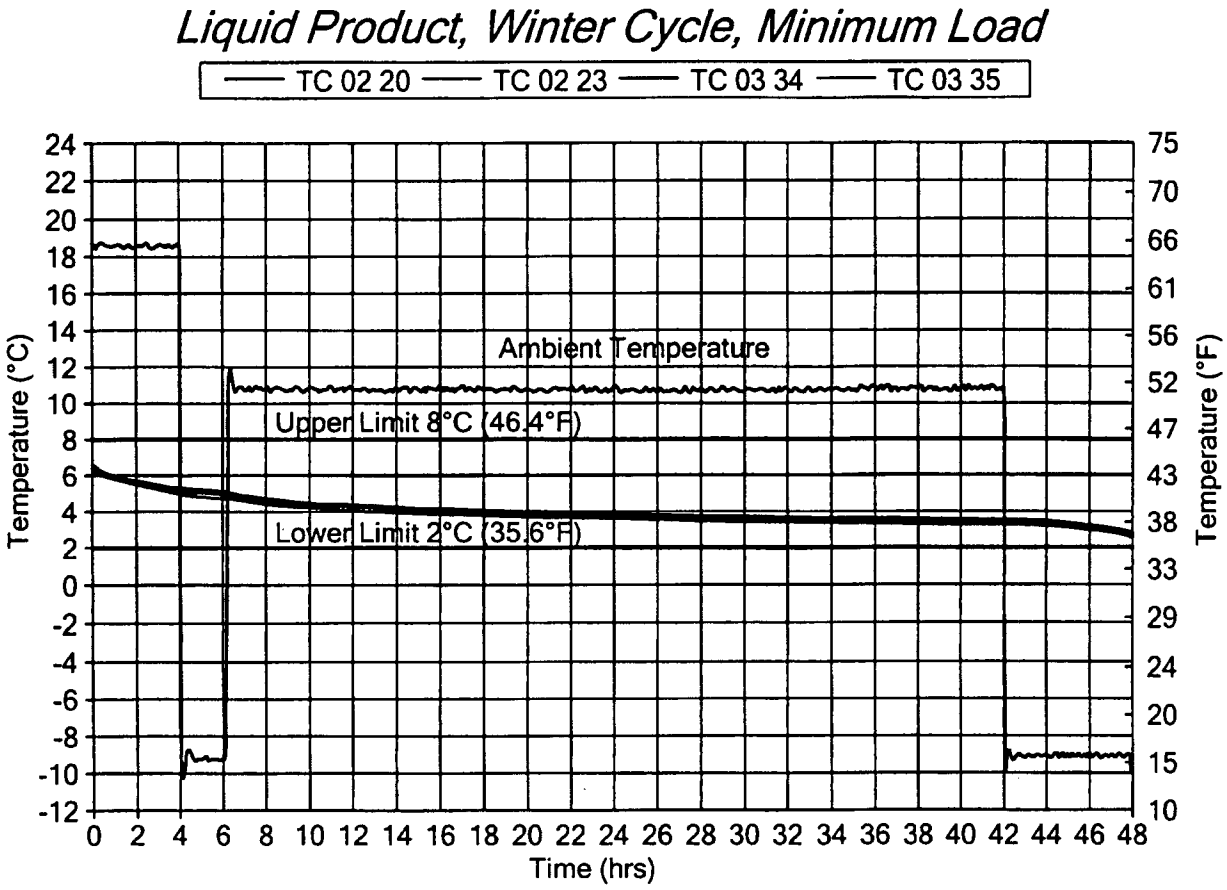
Figure 11:
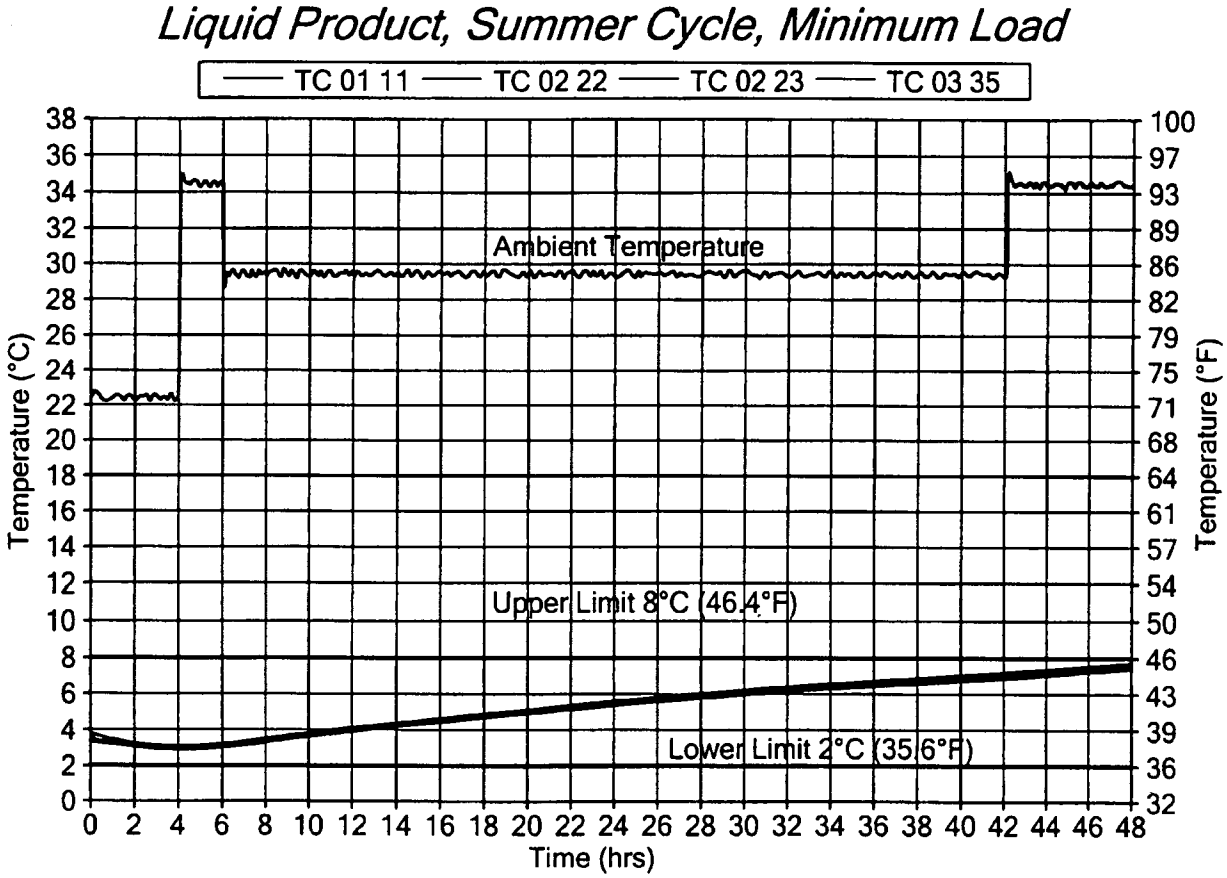
Figure 12:
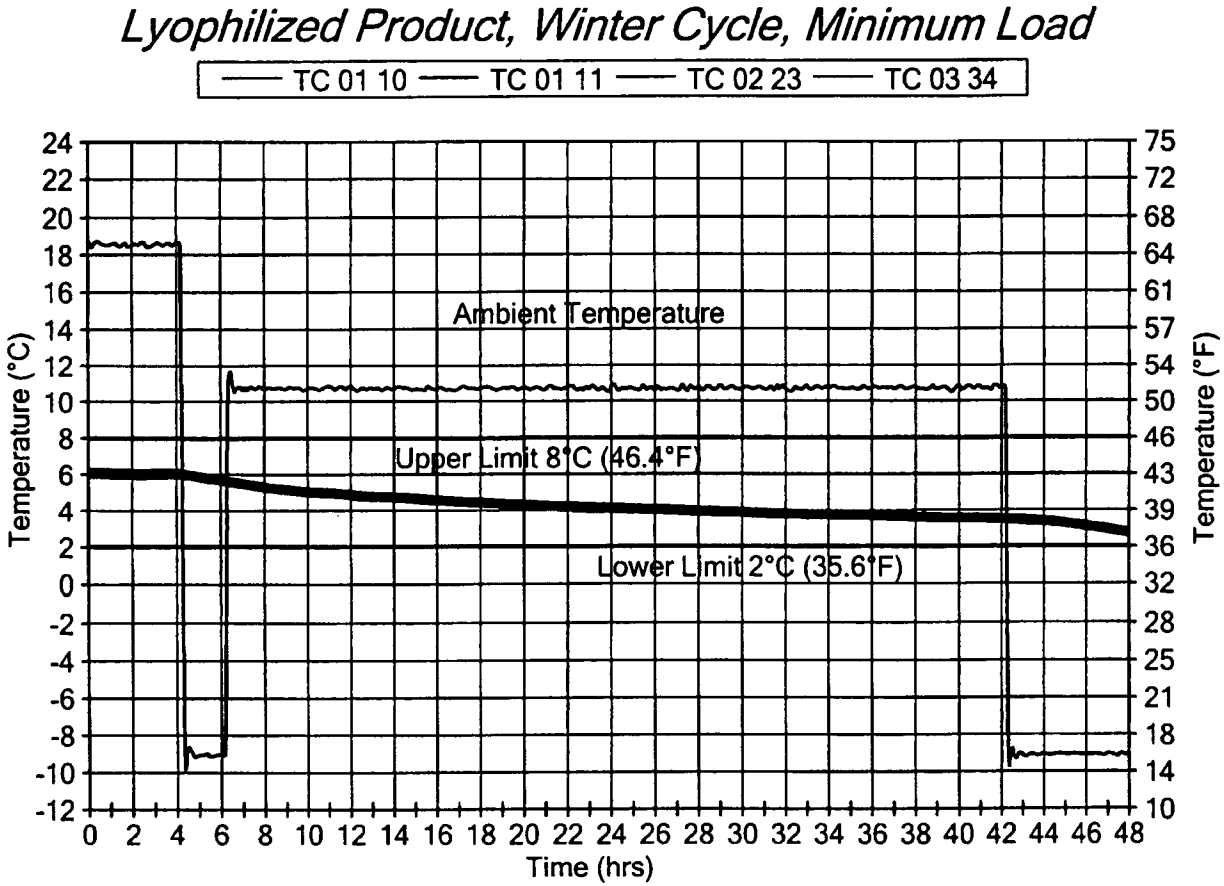
Figure 13:
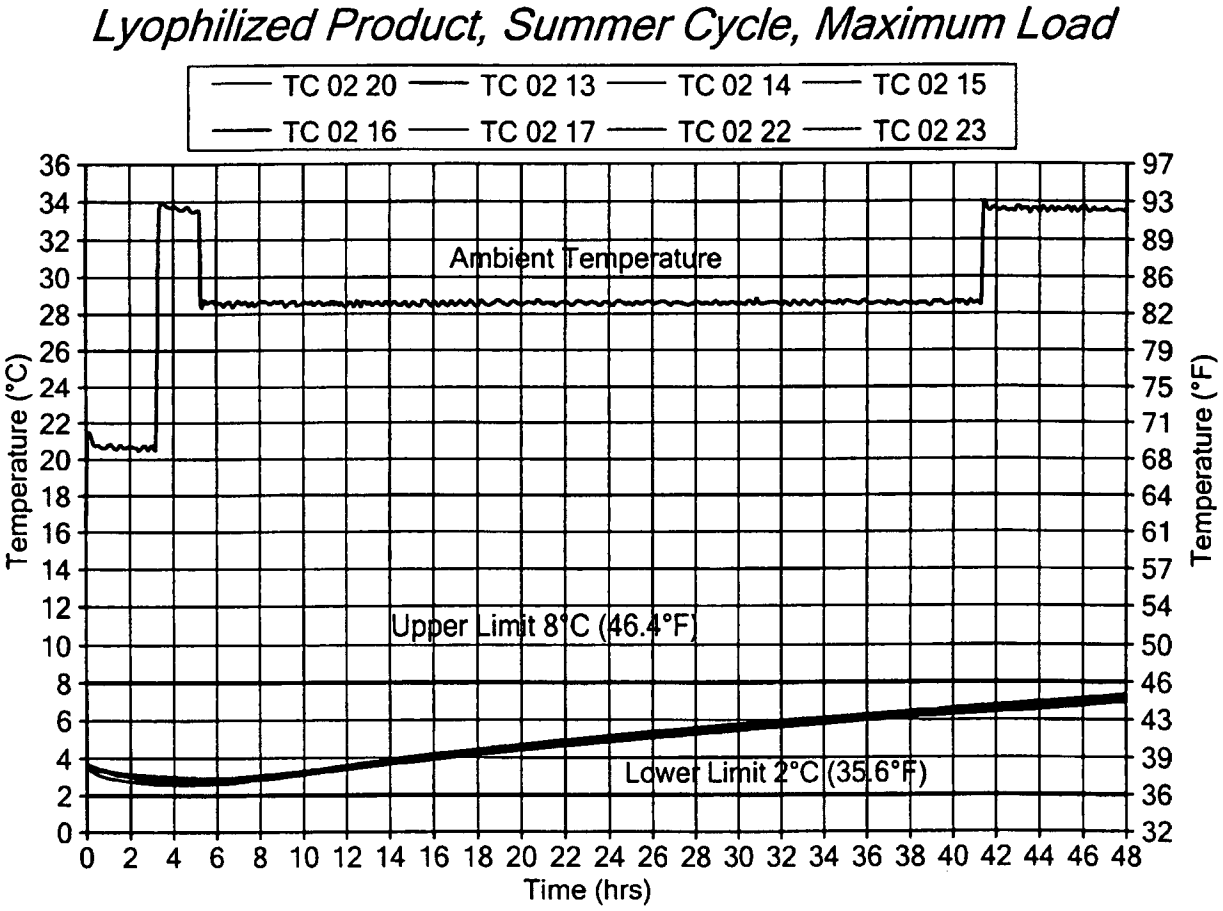

Container 11 may be used in the conventional manner to ship goods. One desirable feature of container 11 is that container 11 can maintain products at a temperature between 2° C. and 8° C. for 48 hours when exposed either to summer-like or to winter-like ambient temperatures. For example, as can be seen by reference to FIGS. 8 through 13, container 11 was subjected to a variety of thermal tests under simulated 48-hour summer and winter conditions and was able to maintain product in the desired 2° C. to 8° C. range for 48 hours. In the maximum load tests (FIGS. 8, 9 and 13), the product load was disposed within payload container 21 and consisted of 16 trays containing 100 2 ml vials filled with liquid, the product load being pre-conditioned at 5° C.±3° C. for a minimum of 24 hours prior to testing. In the minimum load tests (FIGS. 10, 11 and 12), the product load was disposed within payload container 21 and consisted of one 15 ml vial box, the product load being pre-conditioned at 5° C.±3° C. for a minimum of 24 hours prior to testing. For each of the thermal tests, saddlebags 17-1 and 17-2 were pre-conditioned at 5° C.±3° C. for a minimum of 24 hours prior to testing, bricks 19-1 through 19-4 were pre-conditioned at −23° C.±5° C. for a minimum of 24 hours prior to testing, and the remaining components of the container were pre-conditioned at 22° C.±3° C. for a minimum of 24 hours prior to testing.

Figure 14:
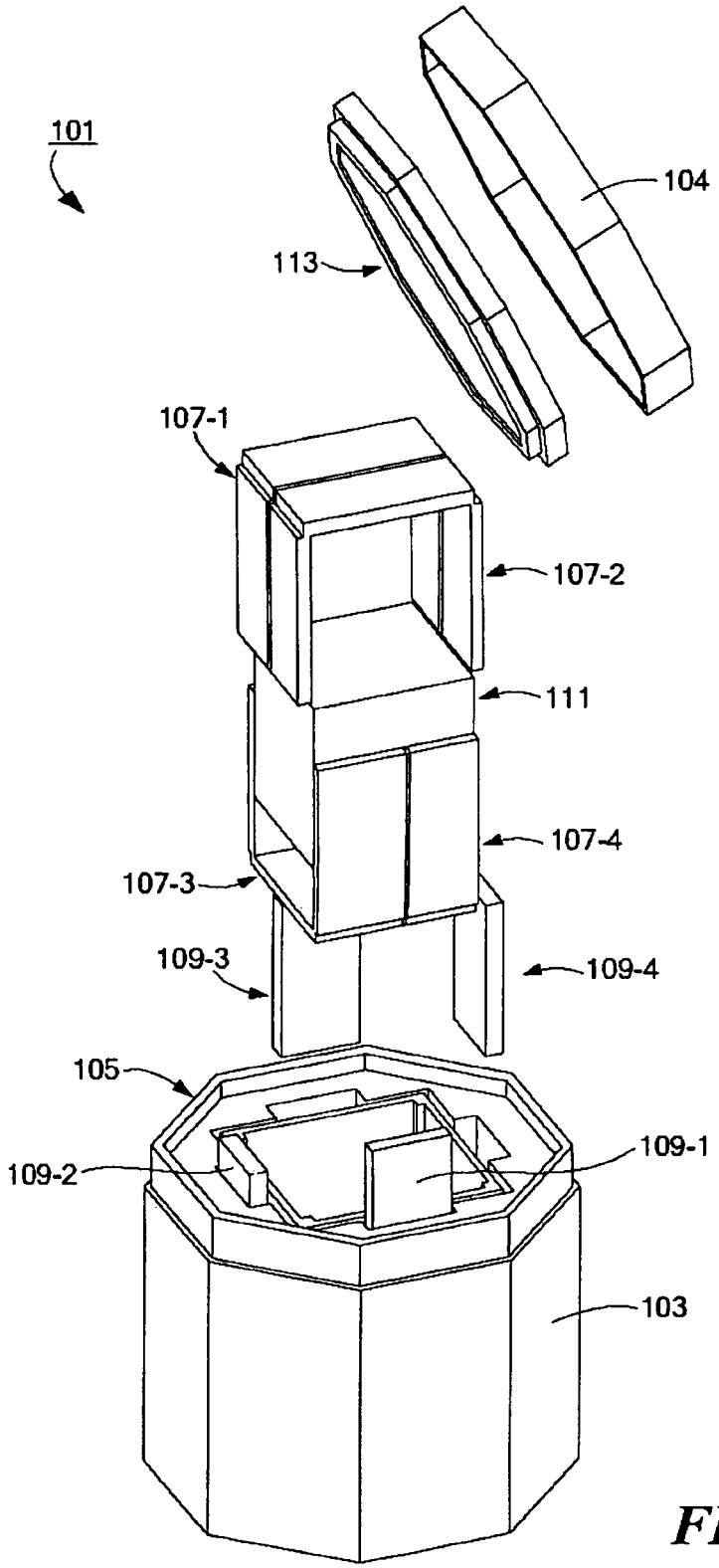
FIG. 14 is a partially exploded perspective view of a second embodiment of an insulated shipping container constructed according to the teachings of the present invention.
Figure 15:
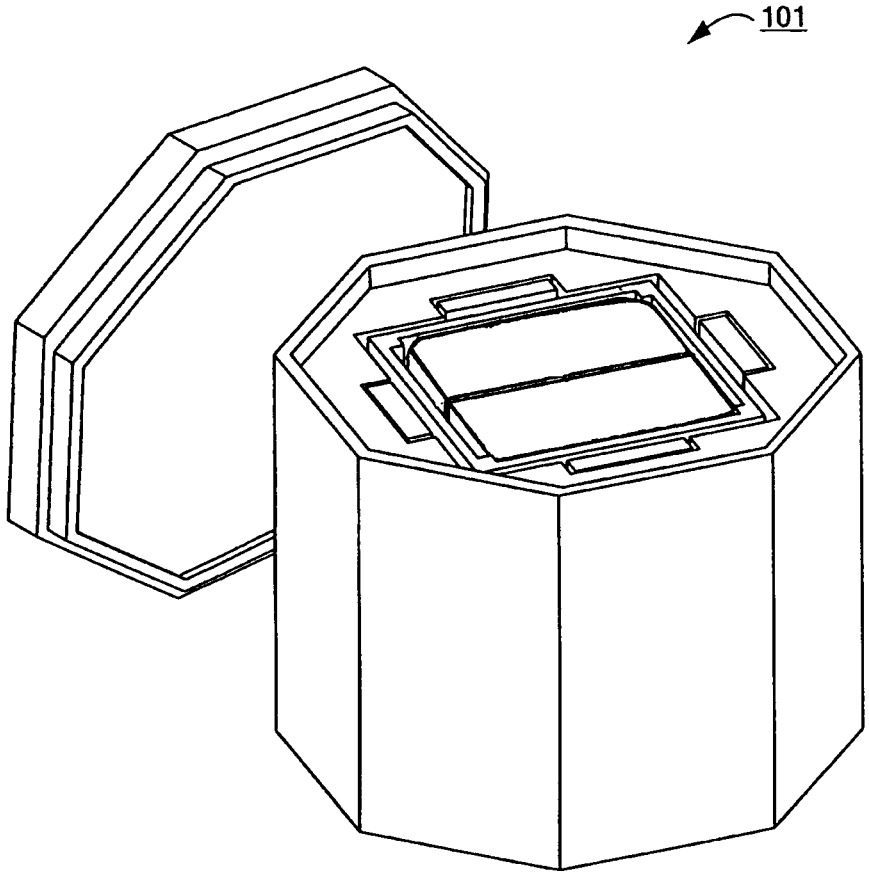
FIG. 15 is a perspective view of the insulated shipping container of FIG. 14, with the lid being shown removed from the base to reveal the contents of the base and with the outer corrugate box not being shown for simplicity.
Figure 16A:
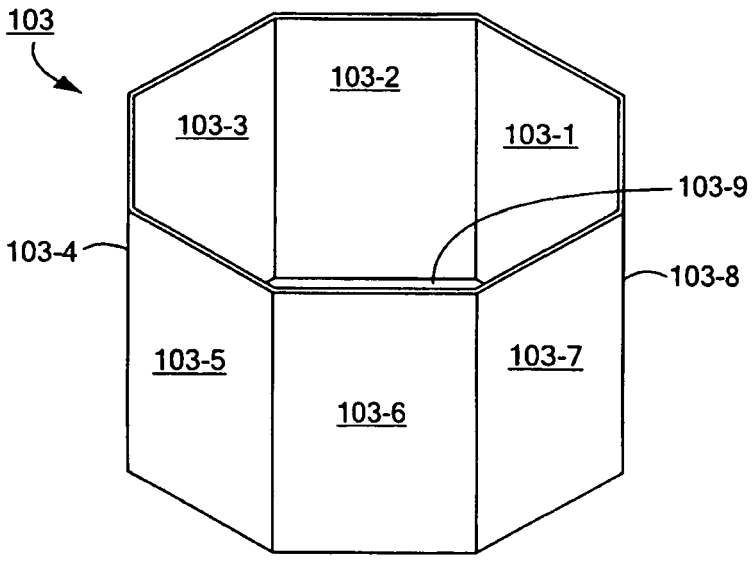
FIGS. 16(*a*) through 16(*d*) are perspective, top, front and side views, respectively, of the bottom portion of the outer corrugate box shown in FIG. 14.
Figure 16B:
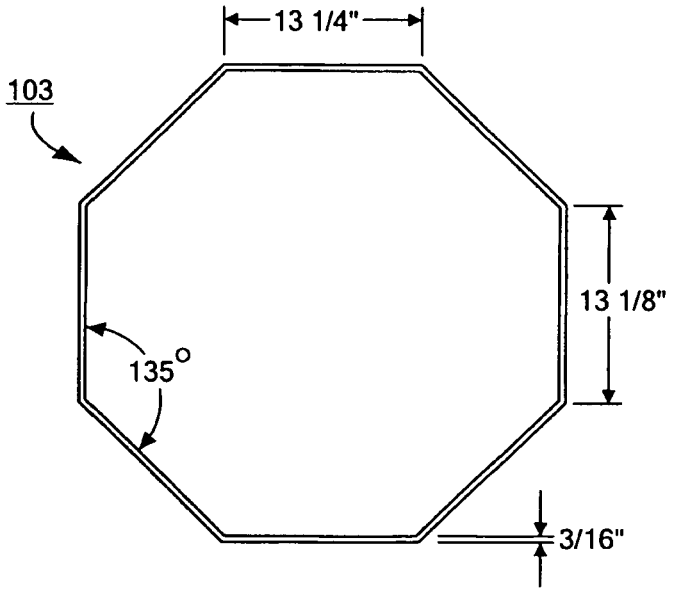
Figure 16C:
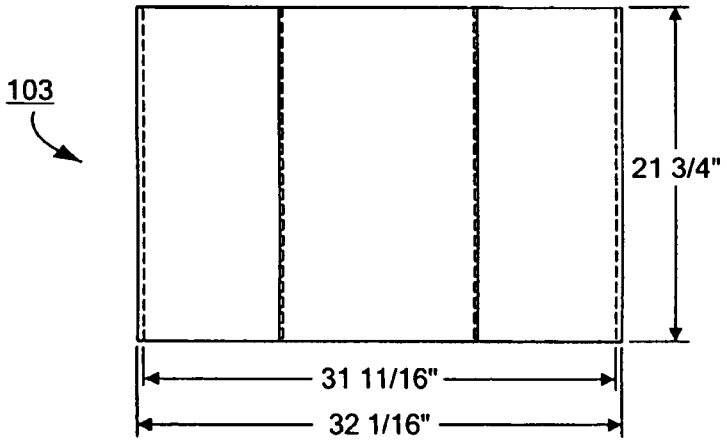
Figure 16D:
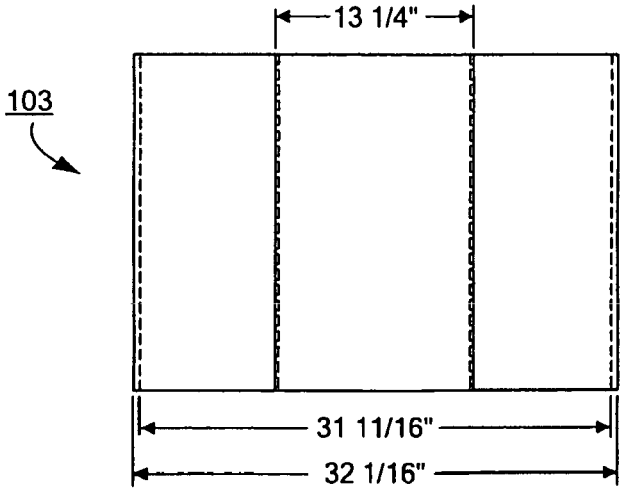

Referring now to FIGS. 14 and 15, there are shown partially exploded perspective and perspective views, respectively, of a second embodiment of an insulated shipping container constructed according to the teachings of the present invention, the insulated shipping container being represented generally by reference numeral 101.

Container 101 comprises an outer box bottom portion 103, an outer box top portion 104, an insulated insert 105, a plurality of coolant saddlebags 107-1 through 107-4, a plurality of coolant bricks 109-1 through 109-4, a payload container 111 and an insulated cover 113. (For simplicity, outer box bottom portion 103 and outer box top portion 104 are not shown in FIG. 15.)

Outer box bottom portion 103, which is also shown separately in FIGS. 16(*a*) through 16(*d*), is preferably a corrugated fiberboard or corrugated plastic box shaped to include an octagonal prismatic cavity having an open top and bounded by a plurality of rectangular side walls 103-1 through 103-8 and a bottom wall 103-9.

Figure 17A:
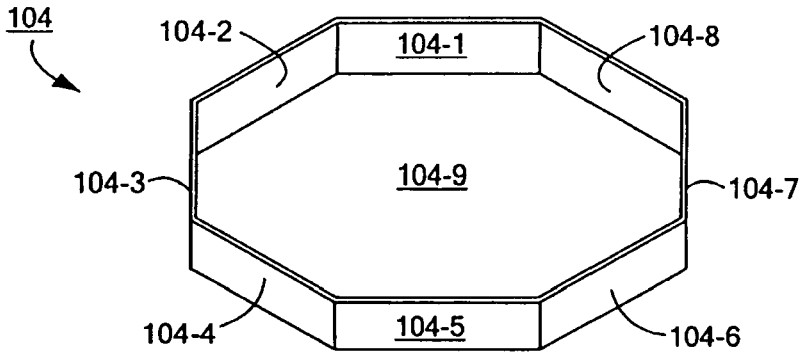
FIGS. 17(*a*) through 17(*c*) are perspective, top and front view, respectively, of the top portion of the outer corrugate box shown in FIG. 14.
Figure 17B:
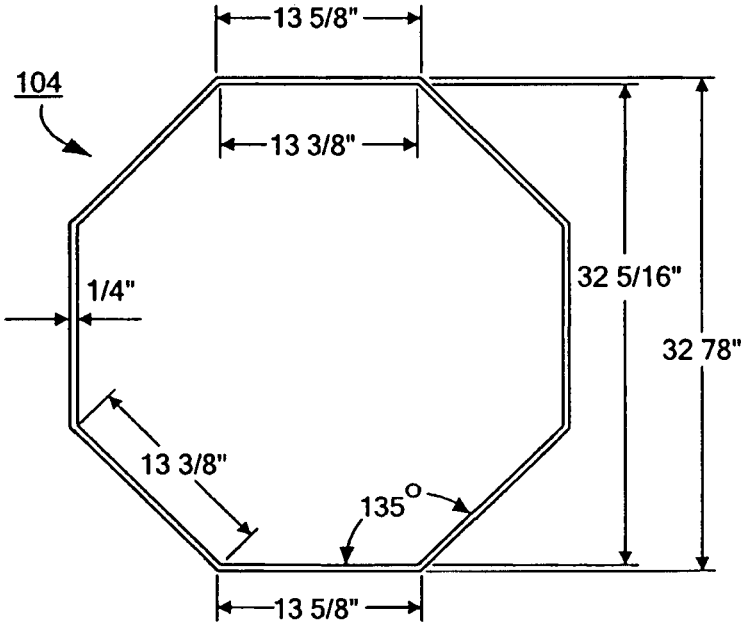
Figure 17C:
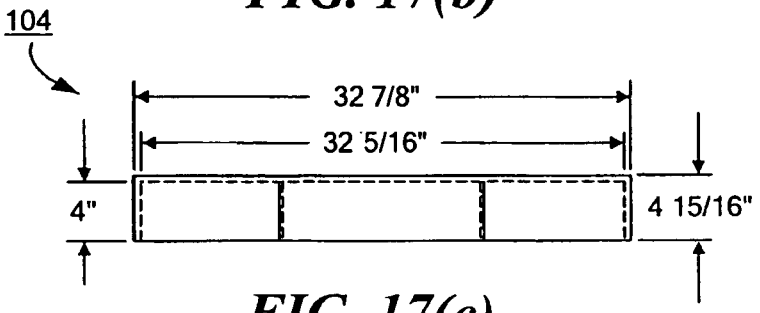

Outer box top portion 104, which is also shown separately in FIGS. 17(*a*) through 17(*c*), is preferably a corrugated fiberboard or corrugated plastic box shaped to include an octagonal prismatic cavity having an open bottom and bounded by a plurality of rectangular side walls 104-1 through 104-8 and a top wall 104-9.

Outer box bottom portion 103 and outer box top portion 104 are appropriately dimensioned to jointly encase the remaining components of container 101. Adhesive strips of tape or other means (not shown) may be used to seal outer box bottom portion 103 and outer box top portion 104 to one another.

Figure 19B:
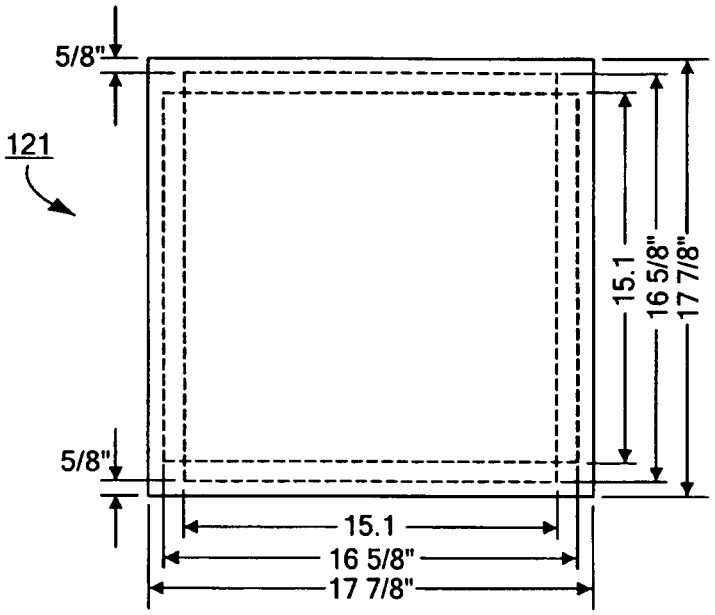
FIGS. 19(*a*) through 19(*d*) are perspective, front and side views, respectively, of the outer body of the insulated insert shown in FIG. 18.
Figure 19C:
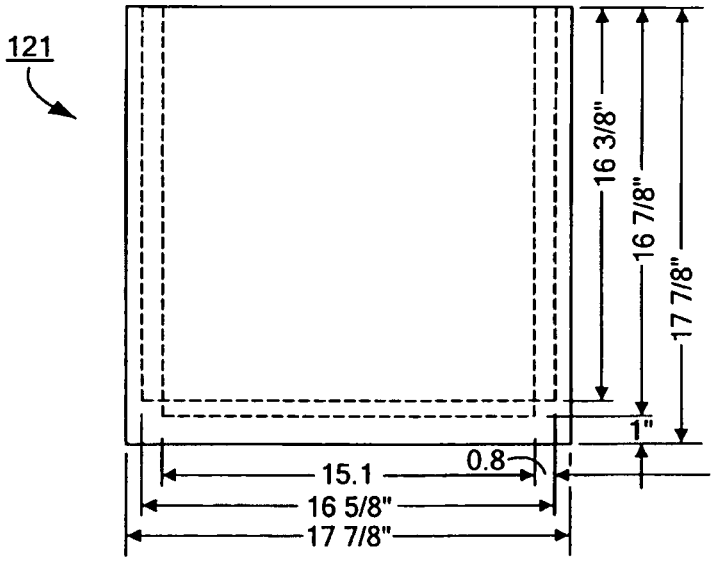
Figure 19D:
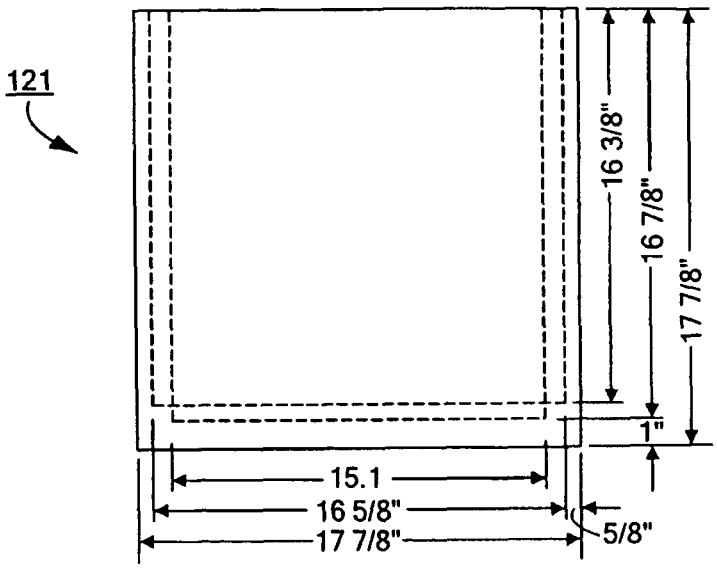

Insulated insert 105, which is also shown separately in FIG. 18, comprises an inner body 121 and an outer body 123, inner body 121 being removably received within outer body 123. Inner body 121, which is also shown separately in FIGS. 19(*a*) through 19(*d*), is shaped to include a generally rectangular prismatic cavity 125 having an open top and bounded by a plurality of side walls 127-1 through 127-4 and a bottom wall 129. A plurality of ribs 131-1 through 131-4 extend along the inside of cavity 125 at the intersection of adjacent walls 127. Cavity 125 is appropriately dimensioned to receive the combination of payload container 111 and saddlebags 107-1 through 107-4.

Figure 20A:
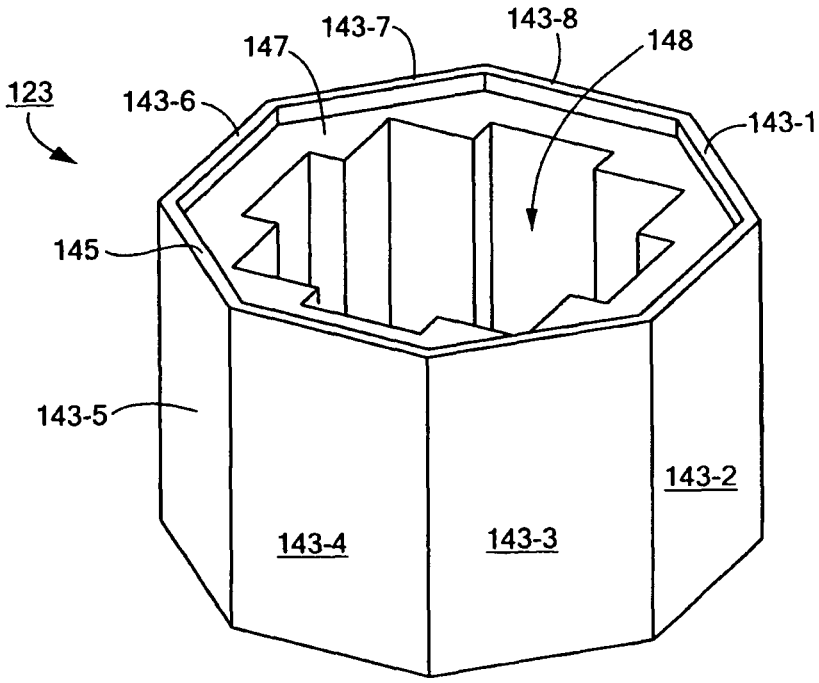
FIGS. 20(*a*) through 20(*c*) are perspective, top, front and side views, respectively, of the inner body of the insulated insert shown in FIG. 18.
Figure 20B:
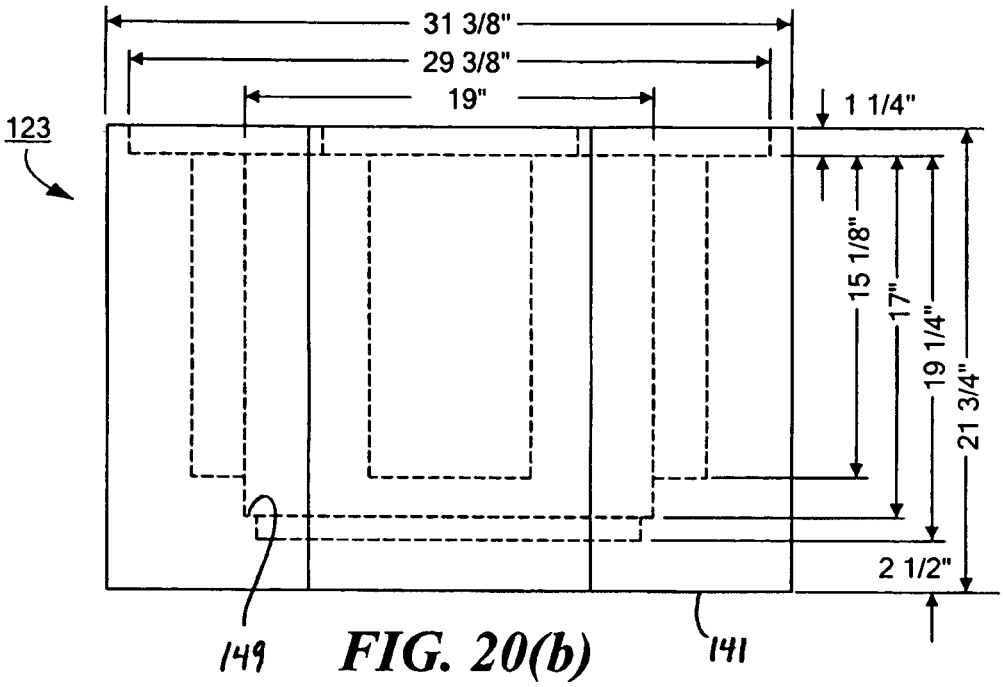
Figure 20C:
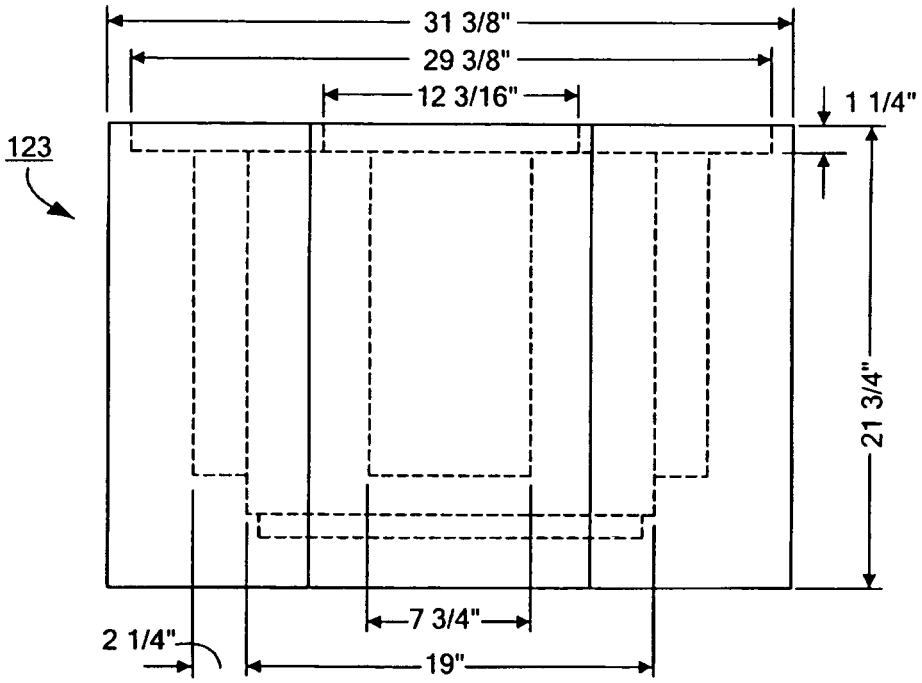
Figure 21C:
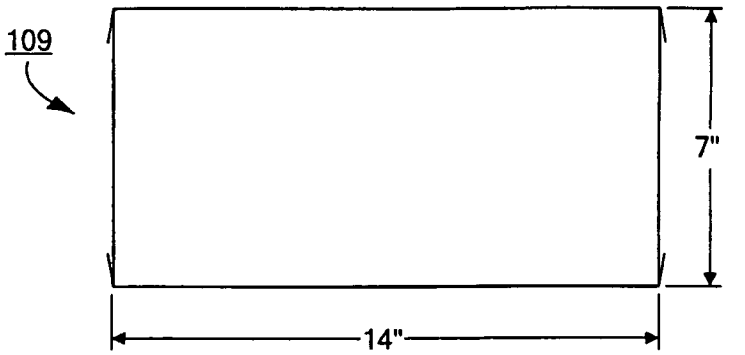
FIGS. 21(*a*) through 21(*d*) are perspective, top, front and side views, respectively, of one of the coolant bricks shown in FIG. 14.
Figure 21D:
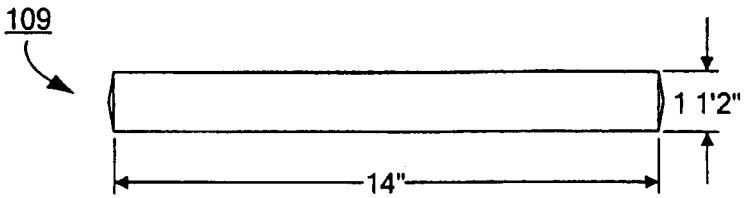
Figure 21A:
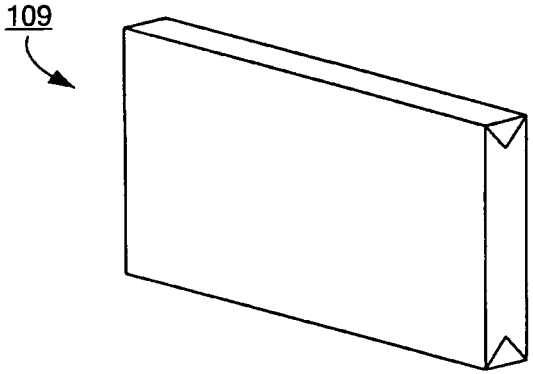
Figure 21B:
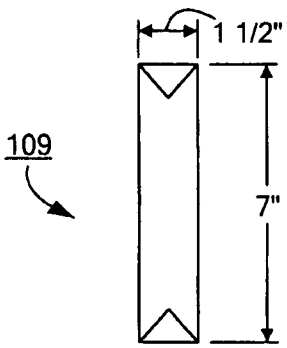
Figure 22A:
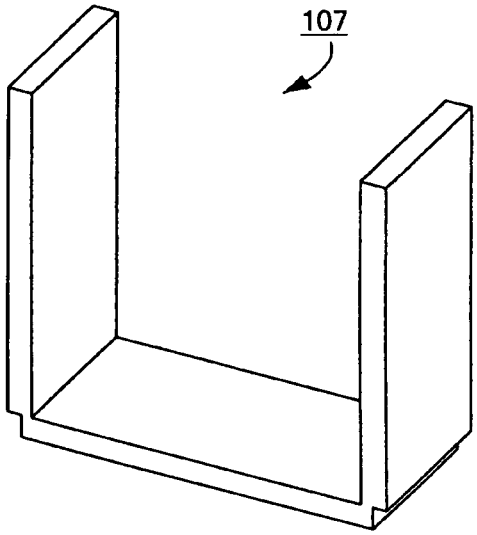
FIGS. 22(*a*) through 22(*d*) are perspective, top, front and side views, respectively, of one of the saddlebags shown in FIG. 14
Figure 22B:
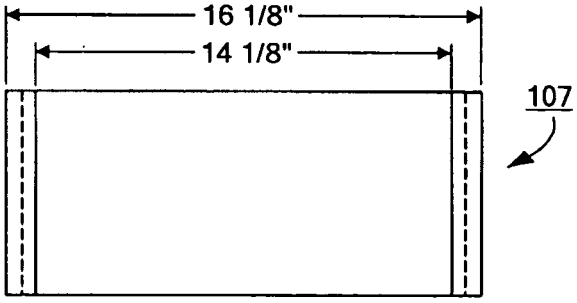
Figure 22C:
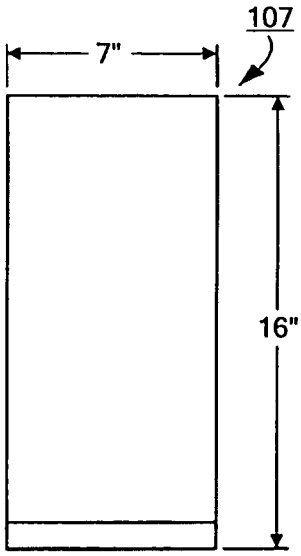
Figure 22D:
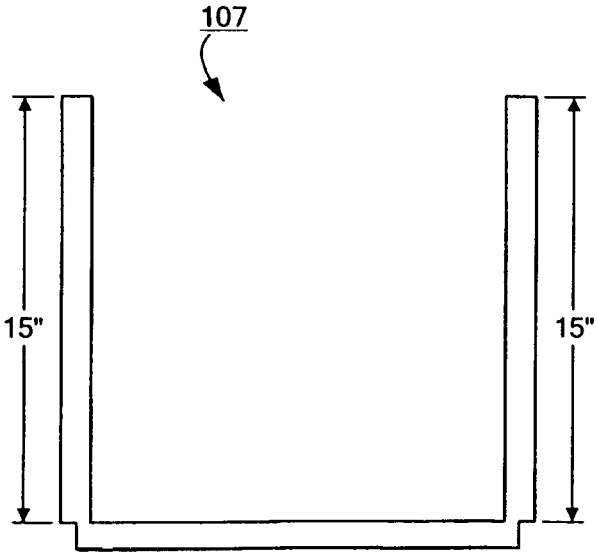
Figure 23A:
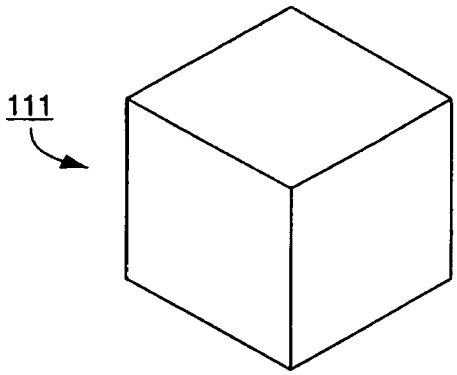
FIGS. 23(*a*) through 23(*d*) are perspective, top, front and side views, respectively, of the payload container shown in FIG. 14.
Figure 23B:
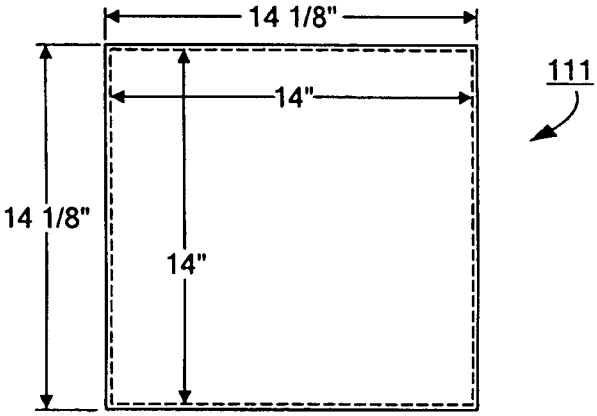
Figure 23C:
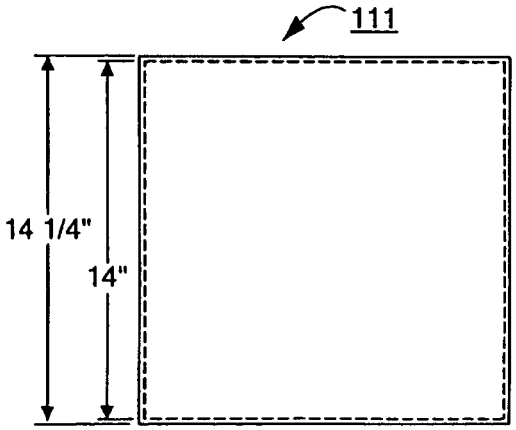
Figure 23D:
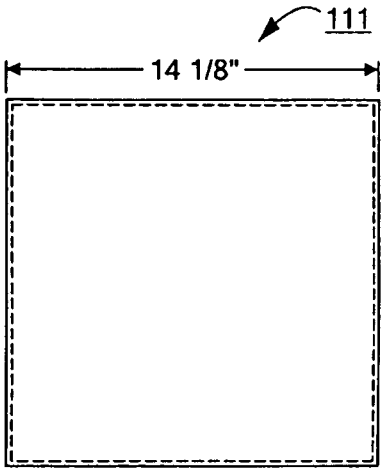
Figure 24A:
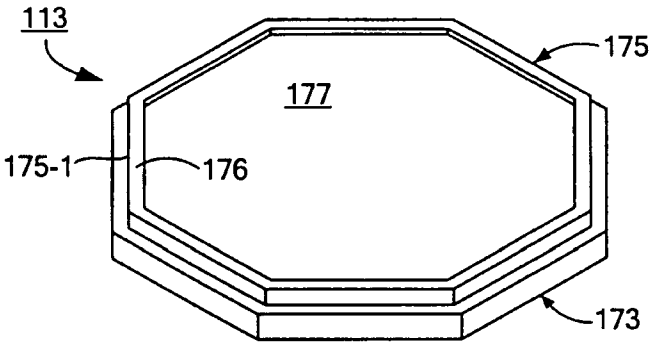
FIGS. 24(*a*) through 24(*d*) are perspective, top, front and side views, respectively, of the lid shown in FIG. 14.
Figure 24C:
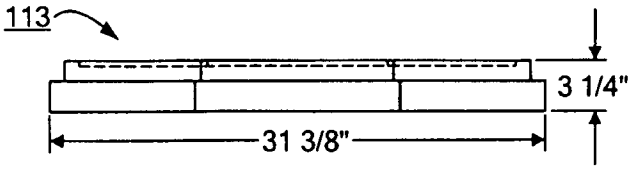
Figure 24D:
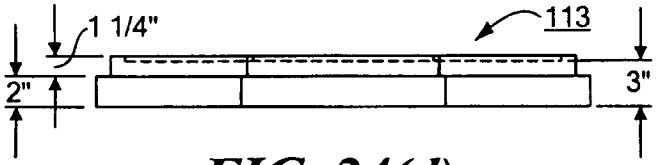
Figure 24B:
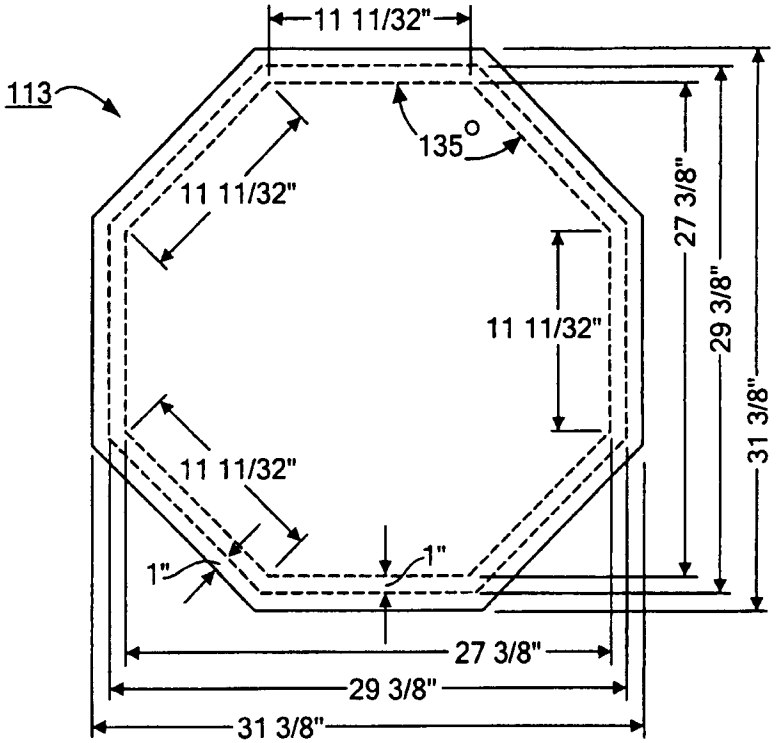

Outer body 123, which is also shown separately in FIGS. 20(*a*) through 20(*c*), is shaped to include a bottom 141, eight side walls 143-1 through 143-8, and a top. The top of outer body 123 is shaped to include a raised peripheral lip 145 surrounding a recessed shelf 147. A multifaceted cavity 148 extends downwardly a distance from shelf 35. A peripheral ridge 149 is formed along the bottom of cavity 148, ridge 149 being appropriately sized and shaped to receive the bottom end of inner body 121.

A continuous coolant space 151 is jointly defined by side walls 127 of inner body 121 and cavity 148 of outer body 123, coolant space 151 being shaped to include a plurality of contiguous segments 151-1 through 151-4. Each segment 151 has a "top hat" shape when viewed from above and is shaped to include a comparatively wider but shorter and shallower "crown" section 153 and a comparatively narrower but longer and deeper "brim" section 155. Section 153 is adapted to loosely receive a coolant brick 109, with the unoccupied portion of section 153 and the completely unoccupied section 155 providing air spaces for convection, such convection being important in endowing container 101 with its thermal properties.

Like insert 15 of container 11, each of inner body 121 and outer body 123 preferably comprises a body of foamed polymer material, preferably a foamed polyurethane (which may be formed using the same types of blowing agents discussed above in connection with cover 23), to which a thin, flexible, non-self-supporting, unfoamed polymer bag, preferably made of hexene or a polyethylene (preferably a high density polyethylene), is integrally and conformingly bonded. The bags preferably cover the respective entireties of inner body 121 and outer body 123, and inner body 121 and outer body 123 may be made in a manner generally similar to that used to make insert 31 of U.S. Pat. No. 6,868,982.

Outer body 123 is slidably removably disposed within the cavity of outer box bottom portion 103, with side walls 143-1 through 143-8 of outer body 123 snugly abutting the inside surfaces of side walls 103-1 through 103-8, respectively, and bottom 141 of outer body 123 seated upon the bottom wall 103-9 of outer box bottom portion 103.

Coolant bricks 109-1 through 109-4, one of which is separately shown in FIGS. 21(*a*) through 21(*d*), comprise a foam refrigerant block (e.g., 7"×14"×1.5") encased in a metal foil. As noted above, bricks 109-1 and 109-4 are dimensioned to loosely fit within sections 153-1 through 153-4, respectively, with the top of each foam refrigerant block preferably positioned a short distance below shelf 147.

Saddlebags 107-1 through 107-4, one of which is separately shown in FIGS. 22(*a*) through 22(*d*), comprise a series of three of foam refrigerant blocks encased within and interconnected by an appropriately sealed metal foil. Saddlebags 107-1 through 107-4 are appropriately dimensioned to be inserted with payload container 111 into cavity 125 with saddlebags 107-1 and 107-2 positioned against payload container 111 along its top and two side faces and saddlebags 107-3 and 107-4 positioned against payload container 111 along its bottom and remaining two side faces.

Payload container 111, which is also shown separately in FIGS. 23(*a*) through 23(*d*), is preferably a corrugated fiberboard or corrugated plastic box and may be conventional in construction. Payload container 111 is adapted to receive a temperature sensitive product. In those instances in which the temperature sensitive product does not occupy the entirety of payload container 111, packaging material (e.g., bubblewrap) may be positioned around the product inside payload container 111 to fill some or all of the remaining space.

Insulated cover 113, which is also shown separately in FIGS. 24(*a*) through 24(*d*), is an octagonal structure shaped to include a top portion 173 and a bottom portion 175. Top portion 173 is appropriately dimensioned to sit upon and to match the outer dimensions of lip 145 of outer body 123. Bottom portion 175 has an outer periphery 175-1 that is appropriately dimensioned to abut the inner surface 145-1 of lip 145, thereby sealing the open top end of outer body 123. However, it should be noted that the bottom surface of bottom portion 175 includes a peripheral lip 176 that serves to space a central portion 177 of the bottom surface of bottom portion 175 from shelf 147 of outer body 123; as a result, a convection space is created between the central portion 177 of the bottom surface of bottom portion 175 and the top surface of shelf 147, said convection space communicating with cavity 151. The present inventors believe that such a convection space is important in endowing container 101 with its thermal properties.

Preferably, cover 113 has a similar construction to inner and outer bodies 121 and 123 and comprises a body of foamed polymer material, preferably a foamed polyurethane (which may be formed using the same types of blowing agents discussed above in connection with cover 23), encased in a thin, flexible, non-self-supporting, unfoamed polymer bag made of hexene or a polyethylene (preferably a high density polyethylene).

Although container 101 may be varied in size to suit particular applications, illustrative dimensions for a preferred embodiment are shown in the drawings.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An insulated shipping container comprising:

(a) an insulated insert, said insulated insert being a unitary body shaped to include a bottom, a plurality of sides and a top, the top including a raised peripheral edge and a recessed shelf, at least one product cavity and at least one coolant cavity extending downwardly from the recessed shelf, the at least one coolant cavity, when viewed from above, having a top-hat shape comprising a crown portion and a brim portion, the at least one coolant cavity by an intermediate piece of insulation being completely physically separate and distinct from the at least one product cavity; and (b) an insulated lid, the insulated lid being removably mounted on the insulated insert in such a way as to cover the top of the insulated insert.

2. The insulated shipping container as claimed in claim 1 wherein said at least one coolant cavity is oriented relative to said at least one product cavity so that said brim portion is positioned between said crown portion and said at least one product cavity.

3. The insulated shipping container as claimed in claim 1 further comprising a coolant member, the coolant member being removably received within the coolant cavity and being adapted to fit within the crown portion of the coolant cavity, with the brim portion of the coolant cavity remaining empty.

4. The insulated shipping container as claimed in claim 3 wherein the coolant member occupies 50% of the volume of the coolant cavity.

5. The insulated shipping container as claimed in claim 1 wherein said at least one coolant cavity comprises a plurality of coolant cavities.

6. The insulated shipping container as claimed in claim 5 wherein said at least one product cavity consists of a single product cavity and wherein said plurality of coolant cavities are spaced around the product cavity.

7. The insulated shipping container as claimed in claim 1 wherein said crown portion is wider, shorter and shallower than said brim portion.

8. The insulated shipping container as claimed in claim 1 wherein said insulated insert and said insulated lid are appropriately dimensioned so that, when said insulated lid is mounted on said insulated insert, an air space is provided between said insulated lid and said recessed shelf of said insulated insert.

9. The insulated shipping container as claimed in claim 1 further comprising a payload container removably disposed within said product cavity.

10. The insulated shipping container as claimed in claim 9 further comprising at least one coolant member removably disposed within said product cavity between the payload container and at least one side wall of the product cavity.

11. An insulated shipping container comprising:

(a) an insulated insert, said insulated insert having an open top and defining a central product cavity and a plurality of coolant cavities surrounding said central product cavity, each of said coolant cavities, when viewed from above, having a top-hat shape comprising a crown portion and a brim portion, and each of said coolant cavities being completely physically separate and distinct from the central product cavity by an intermediate piece of insulation;

(b) an insulated lid, the insulated lid being removably mounted on the insulated insert in such a way as to cover the open top of the insulated insert; and (c) a coolant member removably received in each of said coolant cavities, the coolant member being adapted to fit within the crown portion of the coolant cavity, with the brim portion of the coolant cavity remaining empty.

12. The insulated shipping container as claimed in claim 11 wherein each of said coolant cavities is oriented relative to said central product cavity so that said brim portion is positioned between said crown portion and said central product cavity.

13. The insulated shipping container as claimed in claim 11 wherein said crown portion is wider, shorter and shallower than said brim portion.

14. The insulated shipping container as claimed in claim 11 wherein each coolant member occupies 50% of the volume of its respective coolant cavity.

15. The insulated shipping container as claimed in claim 11 wherein said insulated insert is a unitary body.

16. The insulated shipping container as claimed in claim 15 wherein said unitary body is a substantially rectangular member shaped to include a bottom, four substantially equal sides and a top and wherein the central product cavity is a substantially rectangular prismatic cavity, said substantially rectangular prismatic cavity having corners substantially bisecting the four substantially equal sides.

17. The insulated shipping container as claimed in claim 16 wherein said top of said unitary body includes a raised peripheral edge and a recessed shelf, the central product cavity and the coolant cavities extending downwardly from the recessed shelf.

18. The insulated shipping container as claimed in claim 17 wherein said insulated insert and said insulated lid are appropriately dimensioned so that, when said insulated lid is mounted on said insulated insert, an air space is provided between said insulated lid and said recessed shelf of said insulated insert.

19. The insulated shipping container as claimed in claim 11 further comprising a payload container removably disposed within said central product cavity.

20. The insulated shipping container as claimed in claim 19 further comprising at least one coolant member removably disposed within said central product cavity between the payload container and at least one side wall of the central product cavity.

21. The insulated shipping container as claimed in claim 11 wherein said insulated insert comprises an outer body and an inner body, the inner body being removably received within the outer body, each of the inner body and the outer body comprising an insulated member, the inner body and the outer body jointly defining the plurality of coolant cavities.

22. The insulated shipping container as claimed in claim 21 wherein the inner body is a unitary member shaped to include a generally rectangular prismatic cavity having an open top and bounded by a plurality of side walls and a bottom wall.

23. The insulated shipping container as claimed in claim 22 wherein the outer body is shaped to include a bottom, eight side walls and a top, the top of the outer body being shaped to include a raised peripheral lip surrounding a recessed shelf, with a multifaceted cavity extending downwardly from the recessed shelf, the inner body being removably received within the multifaceted cavity.

24. An insulated shipping container comprising:

(a) an insulated insert, said insulated insert having an open top and defining a product cavity and a coolant cavity, the coolant cavity, when viewed from above, having a top-hat shape comprising a crown portion and a brim portion, the coolant cavity being completely physically separate and distinct from the product cavity by an intermediate piece of insulation; and (b) a coolant member removably received in the coolant cavity, the coolant member being adapted to fit within the crown portion of the coolant cavity, with the brim portion of the coolant cavity remaining empty.

* * * * *